US005524604A

United States Patent [19]

Honda

[11] Patent Number: 5,524,604

[45] Date of Patent: Jun. 11, 1996

[54] METHOD AND APPARATUS FOR SLICING SEMICONDUCTOR WAFERS

[75] Inventor: Katsuo Honda, Mitaka, Japan

[73] Assignee: Tokyo Seimitsu Co., Ltd., Tokyo, Japan

[21] Appl. No.: 87,324

[22] Filed: Jul. 8, 1993

[30] Foreign Application Priority Data

Jul. 16, 1992 [JP] Japan ..... 4-189369
Nov. 4, 1992 [JP] Japan ..... 4-295313

[51] Int. Cl.[6] ..... B28D 1/04

[52] U.S. Cl. ..... 125/13.02; 451/180

[58] Field of Search ..... 451/70, 216, 218, 451/221, 227, 41, 28, 57, 179, 180; 125/13.01, 13.02, 13.03

[56] References Cited

U.S. PATENT DOCUMENTS

| | | | |
|---|---|---|---|
| 3,025,738 | 3/1962 | Winkler | 125/13.02 |
| 3,039,235 | 6/1962 | Heinrich . | |
| 3,232,009 | 2/1966 | Awender | 125/13.02 |
| 4,084,354 | 4/1978 | Grandia et al. | 451/41 |
| 4,127,969 | 12/1978 | Hoshi et al. . | |
| 4,712,535 | 12/1987 | Fujisawa | 125/13.01 |

FOREIGN PATENT DOCUMENTS

| | | |
|---|---|---|
| 2469259 | 5/1981 | France . |
| 62-127206 | 6/1987 | Japan . |
| 63-57203 | 11/1988 | Japan . |

*Primary Examiner* Jack W. Lavinder
*Attorney, Agent, or Firm* Oliff & Berridge

[57] ABSTRACT

A method and apparatus for slicing semiconductor wafers. An inner peripheral cutting edge has a doughnut-shaped blade with electro-deposited diamond grains. The blade is attached to a moving trestle. The moving trestle moves along rails located on both sides of the inner peripheral cutting edge and is driven by instruction signals from a control section. A workpiece is placed within the inner peripheral cutting edge and rotated about the axis thereof by a motor. The motor is mounted on a beam member and is driven by instruction signals from the control section. With this arrangement, the inner peripheral cutting edge is rotated in the direction of arrow A. Then, the moving trestle moves in the direction of arrow B by the control section and the workpiece is pressed against a grindstone on the inner peripheral cutting edge cutting the workpiece by a predetermined value. Thereafter, the moving trestle is stopped by the control section and the workpiece is rotated about the axis thereof by driving the motor to cut the remainder part of the workpiece.

21 Claims, 22 Drawing Sheets

METHOD AND APPARATUS FOR SLICING SEMICONDUCTOR WAFERS

BACKGROUND OF THE INVENTION

1. Field of the Invention

The present invention relates to a method and an apparatus for slicing semiconductor wafers, and in particular, a method and an apparatus for slicing semiconductor wafers by a slicing machine with an inner peripheral cutting edge.

2. Description of the Related Art

In general, a columnar semiconductor material (hereafter, called a "workpiece") is sliced with a thin cutting edge to manufacture thin pieces like semiconductor wafers. An inner peripheral cutting edge of the doughnut-shaped blade in which diamond grains are electro deposited on the inner peripheral edge of the cutting edge. This inner peripheral cutting edge is stretched out at the outer peripheral side of the blade with a predetermined tension by the blade holding device to slice workpieces with high accuracy.

One conventional method for slicing semiconductor wafers with the inner peripheral cutting edge, as shown in FIG. 29, is a method in which the workpiece 1 moves in the direction of arrow B to be cut by the inner peripheral cutting edge 3 while the blade 2 is rotating in the direction of arrow A.

However, in this method for slicing, when an inside diameter of the blade 2 is D1 and an outside diameter is D2, it is necessary that a difference "(D2−D1)"(hereafter, called an "effective blade length") between inside and outside diameters of the blade 2 is larger than a diameter D of the workpiece 1.

The blade 2 is formed by press punching a thin rolled band- plate, and has no sense of direction externally for its circular shape. However, differences of tensile strength exist intrinsically in the radial direction and in the orthogonal direction. Consequently, when the diameter of the blade 2 becomes larger, the tension adjustment of the blade 2 becomes more difficult.

Therefore, the above-mentioned method has disadvantages in that the rigidity of the blade 4 is decreased to lower the processing accuracy of semiconductor wafers and the tension adjustment of the blade becomes extremely difficult when the inside and outside diameters of the blade 4 become larger as the diameter of the workpiece 1 is made bigger.

Another conventianal method shown in FIG. 30 has proposed as a method for slicing semiconductor wafers which solves such disadvantages. This method for slicing cuts the workpiece 1 while the workpiece 1 is rotated in the direction of arrow C and the blade 4 is rotated in the direction of arrow D and moves in the direction of arrow E.

According to this method, an effective blade length of the blade 4 can be reduced to ½ of the workpiece diameter since the workpiece 1 can be cut while the workpiece 1 is rotating. Therefore, it is possible to make the blade 4 smaller than the blade 2 shown in FIG. 29.

However, the conventional method for slicing semiconductor wafers shown in FIG. 30 has a disadvantage in that an apex projection (a cut remainder part) remains at the center of the cut semiconductor wafer.

SUMMARY OF THE INVENTION

The present invention provides a method and an apparatus for slicing semiconductor wafers such that an effective blade length of a blade can be made smaller than a diameter of a semiconductor material and a cut remainder part does not remain at a center of a semiconductor wafer.

To achieve the above-mentioned purpose, a first preferred method for slicing semiconductor wafers comprises the steps of rotating an inner peripheral cutting edge formed on an inner peripheral edge of a doughnut-shaped blade and pressing a columnar semiconductor material against the inner peripheral cutting edge wherein at least one of the inner peripheral cutting edge and the semiconductor material moves in opposite approaching directions by a predetermined value. Then, the semiconductor material is rotated about an axis thereof in opposite directions by a predetermined value, so that the semiconductor wafer can be manufactured.

To achieve the above-mentioned purpose, a second preferred method for slicing semiconductor wafers comprises the steps of rotating an inner peripheral cutting edge formed on an inner peripheral edge of a doughnut-shaped blade and pressing a columnar semiconductor material against the inner peripheral cutting edge wherein the semiconductor material moves obliquely to an advancing direction of said semiconductor material, so that the semiconductor wafer can be manufactured.

To achieve the above-mentioned purpose, a first preferred apparatus for slicing semiconductor wafers comprises a moving means for moving at least one of the inner peripheral cutting edge and the semiconductor material in opposite approaching directions; a rotating means for rotating the semiconductor material about an axis thereof; and a control means for driving the moving means and the rotating means.

To achieve the above-mentioned purpose, a second preferred apparatus for slicing semiconductor wafers comprises a pair of rails parallel to each other and provided on opposite sides of the inner peripheral cutting edge; first and second sliders movably mounted on the pair of rails; an arm, one end of which is rotatably supported by the first slider and the other end of which is movably secured to the second slider, the arm rotates on a planar surface of the inner peripheral cutting edge by moving the first and second sliders, and has a substantially central portion in which the semiconductor material is suspended towards the inner peripheral cutting edge; and a control section for driving under control said first and second sliders.

To achieve the above-mentioned purpose, a third preferred apparatus for slicing semiconductor wafers comprises a pair of rails parallel to each other and located on opposite sides of the inner peripheral cutting edge in a direction X; an arm spanning across the pair of rails in a direction Y, opposite end portions of which are movably secured to the pair of rails, and movably driven on a plane surface of the inner peripheral cutting edge; a slidable member movable in the direction Y along the arm, in which the semiconductor material is suspended towards the inner peripheral cutting edge; and a control section for driving the arm and the slidable member.

To achieve the above-mentioned purpose, a third preferred method for slicing semiconductor wafers comprises the steps of rotating an inner peripheral cutting edge formed on an inner peripheral edge of a doughnut-shaped blade and pressing a columnar semiconductor material against the inner peripheral cutting edge; inclining the semiconductor material towards a surface of the blade by a predetermined angle and rotating the semiconductor material while at least one of said peripheral cutting edge and the semiconductor material moves in opposite approaching directions by a predetermined value, so that the semiconductor wafer can be manufactured.

To achieve the above-mentioned purpose, a fourth preferred method for slicing semiconductor wafers comprises the steps of rotating an inner peripheral cutting edge formed on an inner peripheral edge of a doughnut-shaped blade and pressing a columnar semiconductor material against the inner peripheral cutting edge; moving at least one of the inner peripheral cutting edge and the semiconductor material in opposite approaching directions by a predetermined value, then (1) rotating the semiconductor material to one side by a predetermined angle, causing at least one of the inner peripheral cutting edge and the semiconductor material to perform a cutting operation for a predetermined time $T_1$, therefore, stopping the cutting operation for a predetermined time $T_2$, repeating the cutting operation and the stopping operation for a predetermined time $T_3$, and thereafter; (2) rotating the semiconductor material to the other side by a predetermined angle, causing at least one of the inner peripheral cutting edge and the semiconductor material to perform the cutting operation for a predetermined time $T_1$, stopping the cutting operation for a predetermined time $T_2$, repeating the cutting operation and the stop cutting operation for a predetermined time $T_3$, and; thenceforth, repeating the operations (1) and (2) to manufacture the semiconductor wafer.

To achieve the above-mentioned purpose, a fourth preferred apparatus for slicing semiconductor wafers comprises a moving means for intermittently moving at least one of the inner peripheral cutting edge and the semiconductor material in opposite approaching directions; a rotating means for rotating the semiconductor material to one side by a predetermined angle and to the other side by a predetermined angle, alternately; and a control means for driving the moving means and the rotating means.

According to the first preferred method for slicing semiconductor wafers, the semiconductor material presses against the rotating inner peripheral cutting edge and at least one of the inner peripheral cutting edge and the semiconductor material moves in opposite approaching directions by the predetermined value so that the semiconductor material is cut by the predetermined value. Then, the semiconductor material is rotated about an axis thereof by the predetermined value, so that the remaining parts thereof are cut.

Therefore, the effective blade length can be smaller than the diameter of the semiconductor material. Moreover, a cut remainder part does not remain at the center of the cut semiconductor wafer.

According to the second preferred method for slicing semiconductor wafers, the semiconductor material moves obliquely with respect to the advancing direction to be cut.

Therefore, the effective blade length can be smaller than the diameter of the semiconductor material. Moreover, a cut remainder part does not remain at the center of the cut semiconductor wafer and the slice base of the semiconductor material is rotated to be cut.

According to the first preferred apparatus for slicing semiconductor wafers, the moving means is driven by the control means and the semiconductor material is cut by the predetermined value while at least one of the inner peripheral cutting edge and the semiconductor material moves in opposite approaching directions. The rotating means is driven by the control means and the semiconductor material is rotated about the axis thereof to cut the remainder part.

Therefore, the effective blade length can be smaller than the diameter of the semiconductor material. Moreover, a cut remainder part does not remain at the center of the cut semiconductor wafer.

According to the second preferred apparatus for slicing semiconductor wafers, at least one of the first slider and the second one is driven by the control means and the arm is rotated, so that the semiconductor material is rotated about the axis thereof to be cut.

Therefore, the effective blade length can be smaller than the diameter of the semiconductor material. Moreover, a cut remainder part does not remain at the center of the cut semiconductor wafer.

According to the third preferred apparatus for slicing semiconductor wafers, the arm and the slide member are driven by the control means. Then, the semiconductor material moves in the directions X and Y on a planar surface of the inner peripheral cutting edge and is cut.

Therefore, the effective blade length can be smaller than the diameter of the semiconductor material. Moreover, a cut remainder part does not remain at the center of the cut semiconductor wafer.

According to the third preferred method for slicing semiconductor wafers, while the semiconductor material is inclined to the surface of the blade by a predetermined angle and the rotating inner peripheral cutting edge and the semiconductor material are pressed against each other, the semiconductor material is rotated about the axis passing through a center of a cut surface of the semiconductor material and perpendicular to the surface of the blade while at least the semiconductor material and the inner peripheral cutting edge move in opposite approaching directions.

Therefore, the effective blade length can be smaller than the diameter of the semiconductor material. Moreover, a cut remainder part does not remain at the center of the cut semiconductor wafer.

Alternatively, the semiconductor material may be rotated about the axis passing through a position shifted by the predetermined value from the center of the cut surface of the semiconductor material and perpendicularly intersects the surface of the blade.

According to the fourth preferred method for slicing semiconductor wafers, after at least one of the inner peripheral cutting edge and the semiconductor material move in opposite approaching directions by a predetermined value, then (1) rotating the semiconductor material about the axis thereof to one side by a predetermined angle, causing at least one of the inner peripheral cutting edge and the semiconductor material to perform cutting operation for the predetermined time $T_1$, thereafter, stopping the cutting operation for a predetermined time $T_2$, repeating the cutting operation and stop cutting operation for a predetermined time $T_3$, and thereafter; (2) rotating the semiconductor material about the axis thereof to the other side by a predetermined angle, causing at least one of the inner peripheral cutting edge and the semiconductor material to perform cutting operation for the predetermined time $T_1$, thereafter, stopping the cutting operation for a predetermined time $T_2$, repeating the cutting operation and the stop cutting operation for a predetermined time $T_3$, and; repeating the operations (1) and (2).

Therefore, the effective blade length can be smaller than the diameter of the semiconductor material. Moreover, a cut remainder part does not remain at the center of the cut semiconductor wafer.

Alternatively, the semiconductor material may be rotated about the axis passing through the center of the cut surface of the semiconductor material and perpendicularly intersects the surface of the blade.

Further, the semiconductor material may be rotated about the axis passing through a position shifted by the predetermined value from the center of the cut surface of the semiconductor material and perpendicularly intersects the surface of the blade.

According to the fourth preferred apparatus for slicing semiconductor wafers, at least one of the inner peripheral cutting edge and the semiconductor material intermittently moves in opposite approaching directions. Then, the semiconductor material is cut while the semiconductor material is rotated about the axis thereof to one side by a predetermined angle and at the other side a predetermined angle, alternately, by a rotating means.

Therefore, the effective blade length can be smaller than the diameter of the semiconductor material. Moreover, a cut remainder part does not remain at the center of the cut semiconductor wafer.

Alternatively, the semiconductor material may be inclined to the surface of the blade by a predetermined angle by a tilting means. Thereafter, the semiconductor material may be rotated about the axis passing through the center of the cut surface of the semiconductor material and perpendicularly intersects the surface of the blade while at least one of the inner peripheral cutting edge and the semiconductor material moves in opposite approaching directions by the moving means.

Further, the semiconductor material may be rotated about the axis passing through the center of the cut surface of the semiconductor material and perpendicularly intersects the surface of the blade at one side by a predetermined angle and at the other side by a predetermined angle by the rotating means.

According to the fifth preferred apparatus for slicing semiconductor wafers, the semiconductor material is inclined to the surface of the blade by the tilting means. Then, the semiconductor material is rotated about the axis passing through a position shifted from the center in the cut surface of the semiconductor material by a predetermined value and perpendicularly intersects the surface of the blade while at least one of the inner peripheral cutting edge and the semiconductor material moves in opposite approaching directions by the moving means.

Therefore, the effective blade length can be smaller than the diameter of the semiconductor material. Moreover, a cut remainder part does not remain at the center of the cut semiconductor wafer.

BRIEF DESCRIPTION OF THE DRAWINGS

The exact nature of the invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE PREFERRED EMBODIMENTS

A detailed description will hereunder be given of the preferred embodiments of a method and an apparatus for slicing semiconductor wafers according to the invention with reference to the accompanying drawings.

Figure 1:
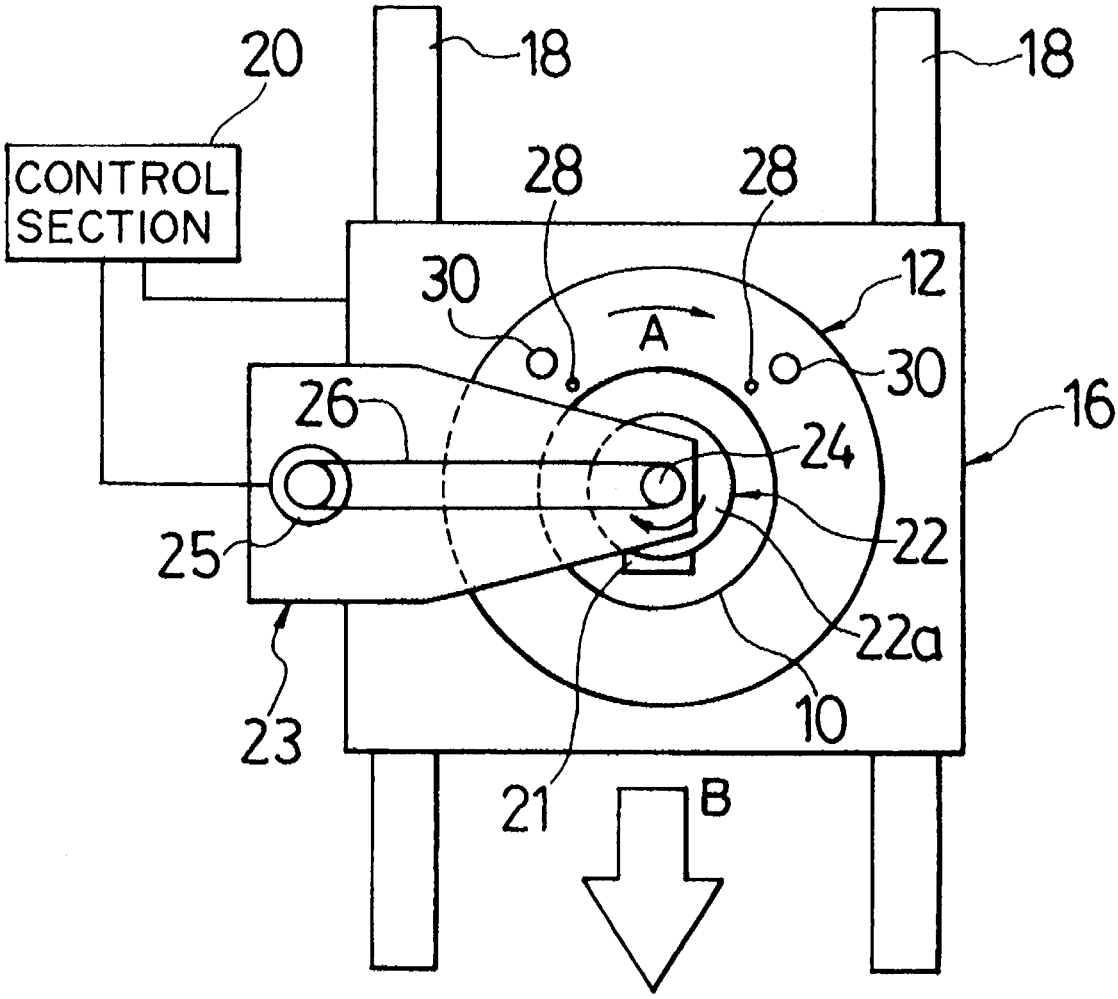
FIG. 1 is a explanatory view showing the first preferred embodiment of an apparatus for slicing semiconductor wafers according to the invention.

FIG. 1 is a first preferred embodiment of an apparatus for slicing semiconductor wafers according to the invention.

Diamond grains are electro deposited on the inner peripheral edge of a doughnut-shaped blade 12 forming an inner peripheral cutting edge 10. The inner peripheral cutting edge 10 is stretched out at the outer peripheral edge of the blade 12 thereof by a chuck body not shown, and rotatable in the direction of an arrow A by turning effort from a spindle not shown. Further, the inner peripheral cutting edge 10 is held in a rectangular moving trestle 16 with the spindle.

The moving trestle 16 is mounted on rails 18 and 18 which are set at both sides of the inner peripheral cutting edge 10 in parallel movable in the direction of arrow B, and driven by instruction signals from a control section 20.

A workpiece 22 is arranged on the inner peripheral cutting edge 10. The workpiece 22 is arranged under a beam member 23 rotatably fixed to the main body of the slicing apparatus around the axis thereof. A pulley 24 is fixed on a top part 22*a* of the workpiece 22 and connected with the rotating mechanism which consists of a motor 25 and a belt 26. The motor 25 is fixed on the beam member 23. The motor 25 is driven by the instruction signals from the control section 20.

A pair of non-contact type blade sensors 28 and 28 and air pads 30 and 30 are located at each side of the blade 12 as shown in FIG. 1.

The blade sensors 28 and 28 are connected to a controller (not shown). The controller controls the air pressure control device (not shown) according to a displacement of the blade 12 detected by the blade sensors 28 and 28 to operate the air pads 30 and 30. Thus, the displacement (warp) of the blade 12 can be corrected.

According to the apparatus for slicing semiconductor wafers constructed in the above mentioned manner, the inner peripheral cutting edge 10 is rotated in the direction of arrow A. Then, the moving trestle 16 moves in the direction of arrow B driven by the control section 20 to cut the workpiece 22 by a predetermined value while the grindstone 14 of the inner peripheral cutting edge 10 presses against the workpiece 22. Next, the control section 20 stops the moving trestle 16 and drives the motor 25 to rotate the workpiece 22 about the axis thereof by the predetermined value, and then the remainder part is cut.

Therefore, the effective blade length of the blade 12 can be smaller than the diameter of the workpiece 22. Moreover, a cut remainder part does not remain at the center of the cut semiconductor wafer.

FIGS. 2–5 and FIG. 9 shows the cutting loci on the surface of the semiconductor wafer 32 cut with the apparatus for slicing semiconductor wafers of FIG. 1.

Figure 2:
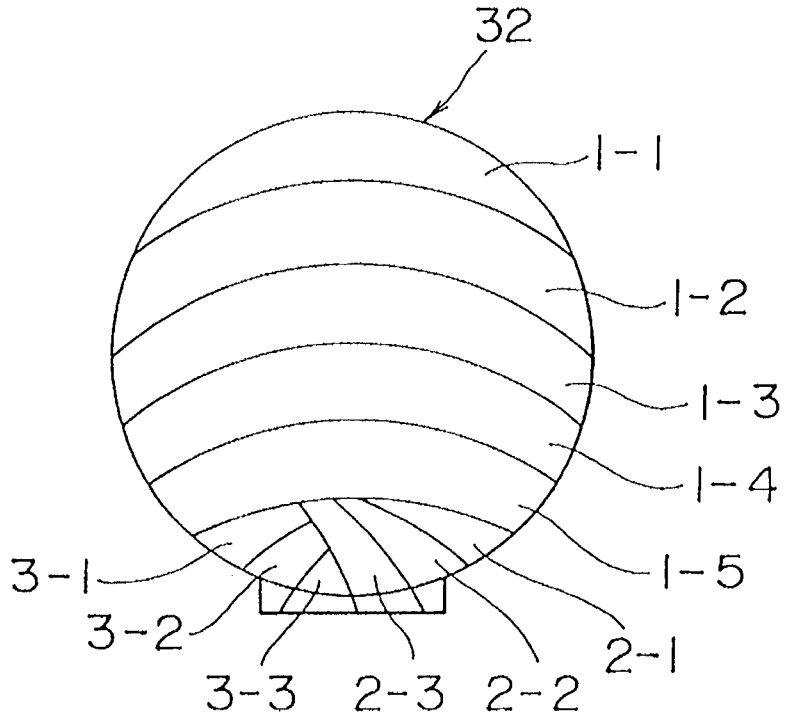
FIG. 2 shows cut loci of the semiconductor wafer cut by the apparatus for slicing semiconductor wafers shown in FIG. 1.

In FIG. 2, cut loci from 1-1 to 1-5 are deposited by moving the trestle 16 shown in FIG. 1 in the direction of arrow B and cut loci from 2-1 to 2-3 are created by rotating the workpiece 22 counterclockwise and stopping and the moving trestle 16. The cut loci from 3-1 to 3-3 are created by rotating the workpiece 22 clockwise. Thus, the cut remainder part does not remain at the center of the semiconductor wafer 32.

Figure 3:
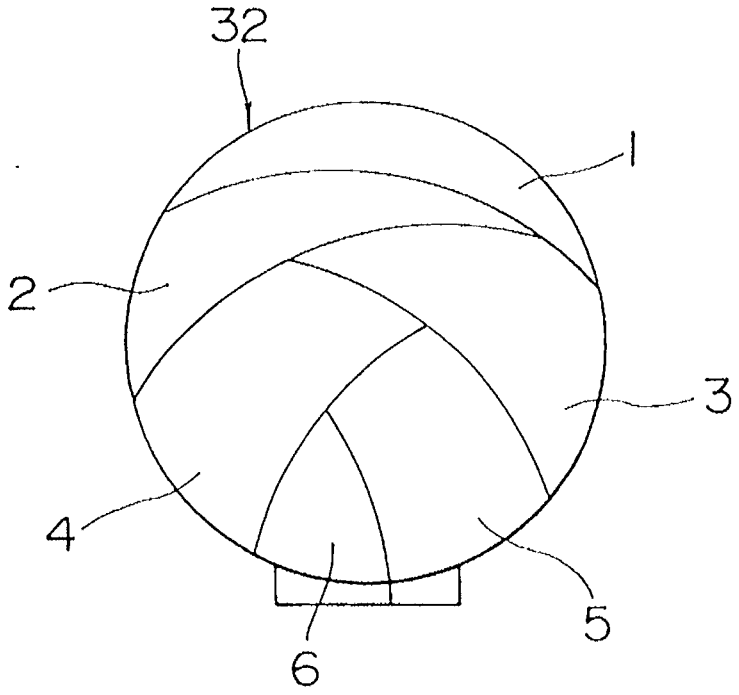
FIG. 3 shows cut loci of the semiconductor wafer cut by the apparatus for slicing semiconductor wafers shown in FIG. 1.

In FIG. 3, cut loci 1-6 are created by moving the trestle 16 shown in FIG. 1 in the direction of arrow B and rotating the workpiece 22, alternatively. In this case, the cut remainder part also does not remain at the center of the semiconductor wafer 32.

Figure 4:
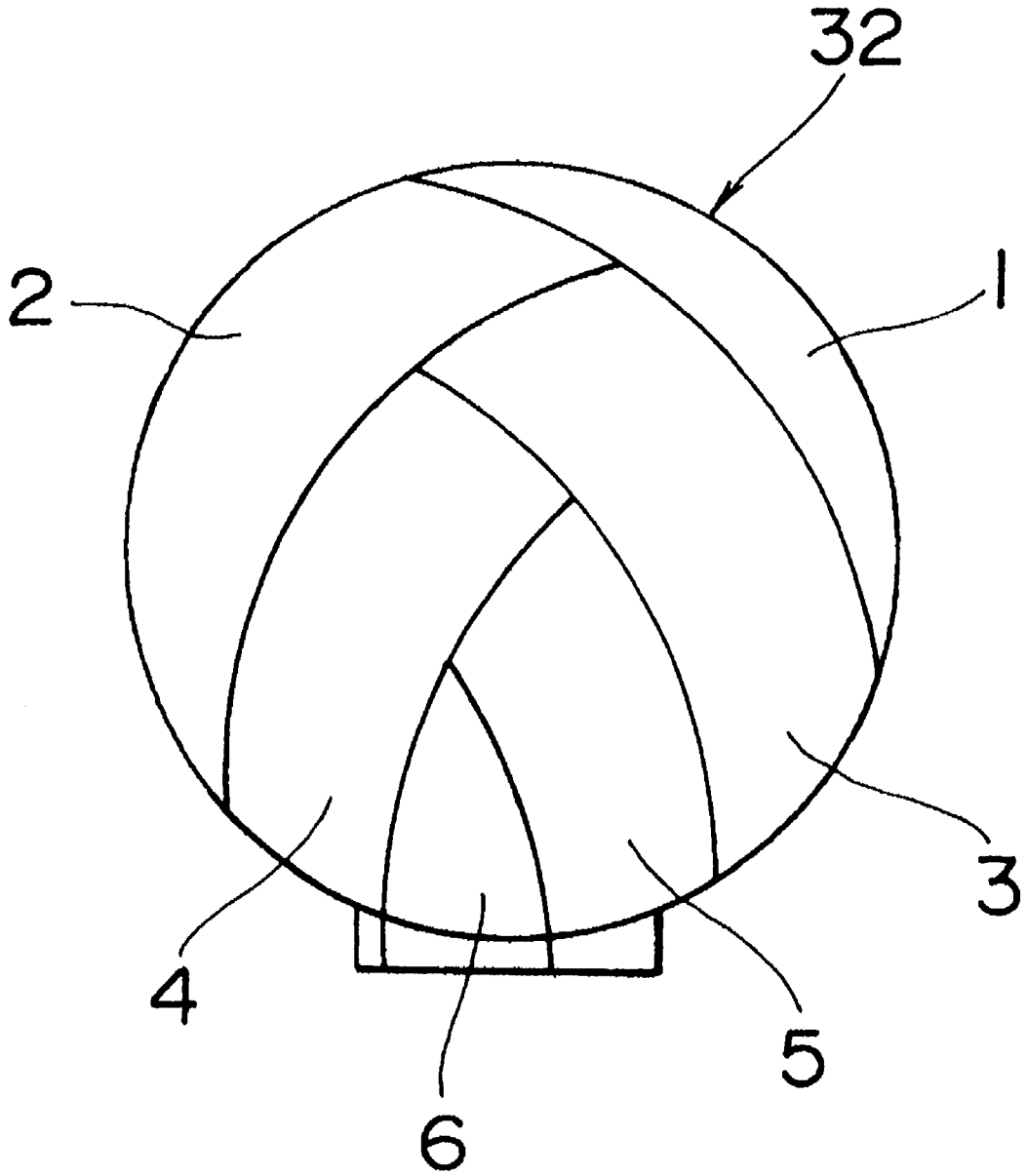
FIG. 4 shows cut loci of the semiconductor wafer cut by the apparatus for slicing semiconductor wafers shown in FIG. 1.

In FIG. 4, cut loci 1-6 are created by moving the trestle 16 at lower speed than FIG. 3 and rotating the workpiece 22 alternately by an angle more obtuse than FIG. 3. In this case, the cut remainder part also does not remain at the center of the semiconductor wafer 32.

Figure 5:
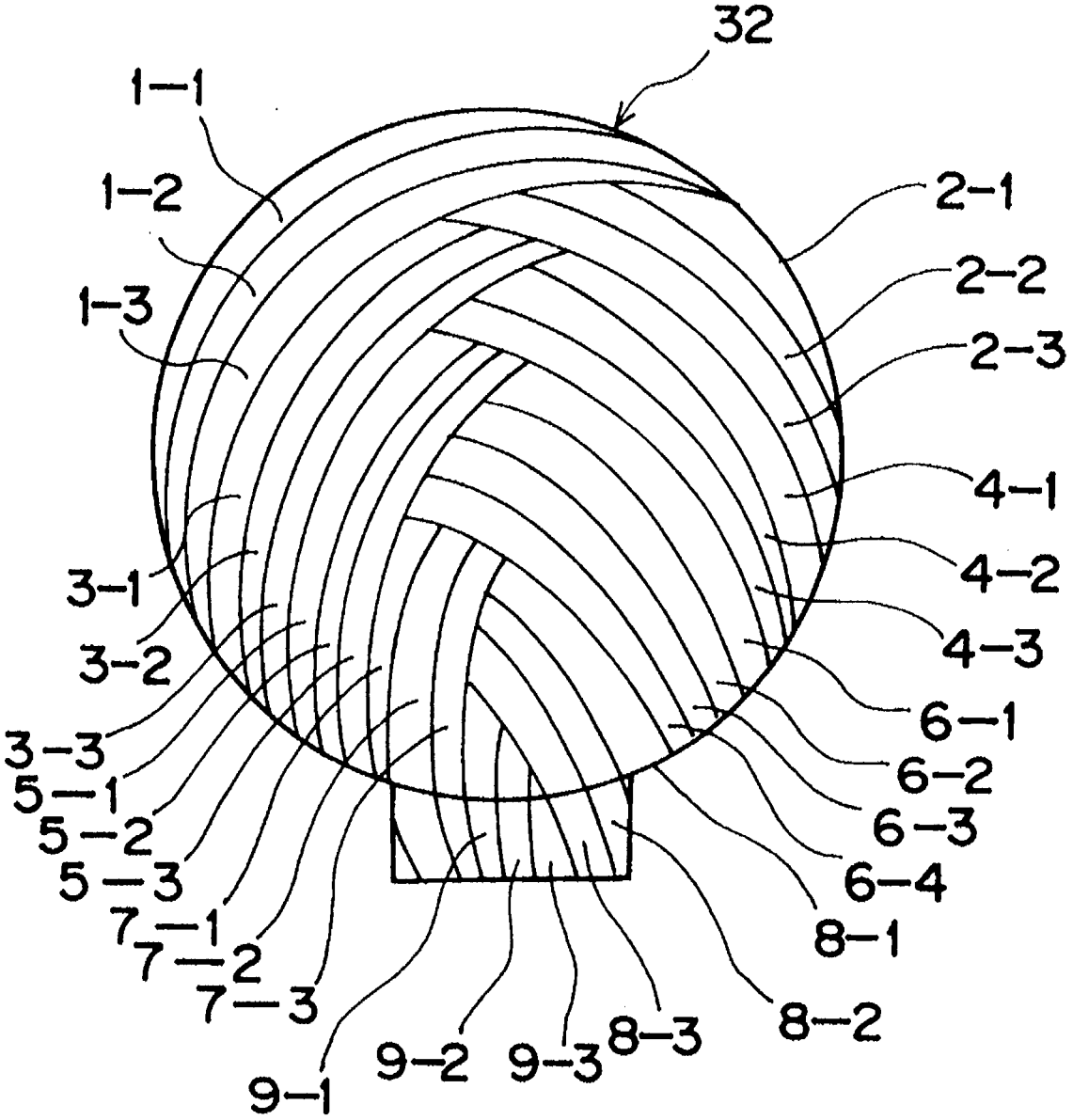
FIG. 5 shows cut loci of the semiconductor wafer cut by the apparatus for slicing semiconductor wafers shown in FIG. 1.

In FIG. 5, cut loci 1-6 are created by intermittently cutting (repeating the cutting and the feeding) the workpiece 22 and by rotating counterclockwise by an acute angle and cut loci from 2-1 to 2-3 are created by intermittently cutting the workpiece 22 and by rotating clockwise by an acute angle. Cut loci from 3-1, 3-2 and 3-3 to 9-1, 9-2 and 9-3 are created by repeating the intermittent cutting shown from 1-1 to 1-3 and from 2-1 to 2-3 alternately. Thus, the cut remainder part does not remain at the center of the semiconductor wafer 32.

According to the method for slicing shown in FIG. 5, the cutting pitch difference appearing at the border between the counterclockwise and clockwise cutting are made much smaller than using the method for slicing semiconductor wafers disclosed in the Japan Patent Application laid-open No. 62-127206. Thus, the flection does not appear when lapping during later treatment.

Figure 6:
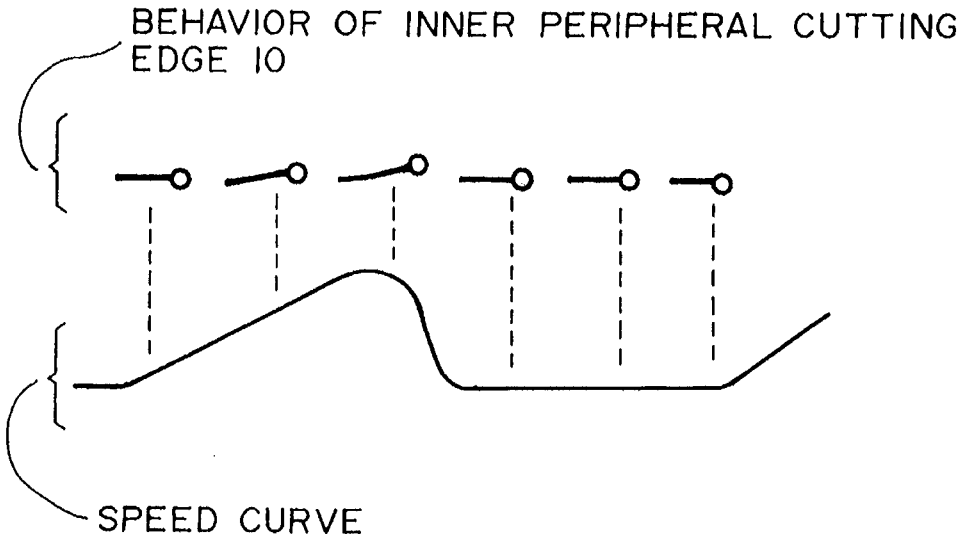
FIG. 6 is an explanatory view showing a local displacement of an inner peripheral cutting edge.
Figure 7:
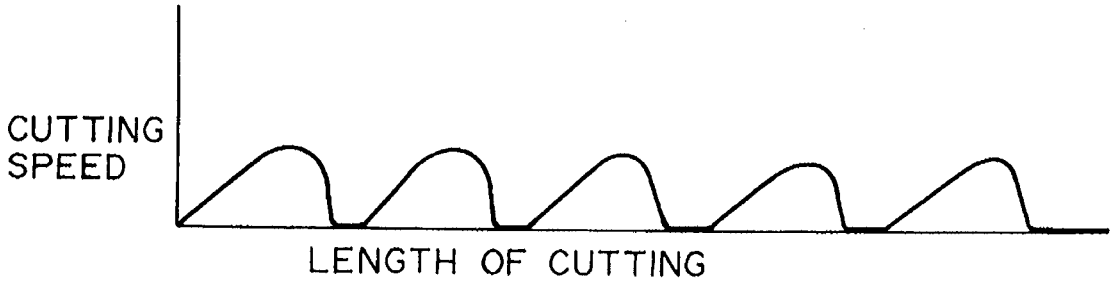
FIG. 7 is an explanatory view showing a cutting speed of an inner peripheral cutting edge.

Generally, the relationships between a cutting resistance, a cutting length and the feeding speed of the workpiece 22 are such that when the cutting length is longer and the feeding speed of the workpiece 22 is higher, the cutting resistance is stronger. Further, when the cut resistance becomes stronger, the displacement of the blade 12 will obviously become larger, so that the blade 12 can easily warp. The warping of the blade 12 is detected by the pair of non-contact type blade sensors 28 and 28. In the embodiment shown in FIG. 6, the blade displacement (warp) becomes gradually larger as the cutting length becomes longer and when the displacement exceeds a predetermined value, the feeding of the workpiece 22 is stopped. With this arrangement, the cutting resistance of the blade 12 weakens rapidly, so that the blade 12 returns to its original position by a self restoring force (since the blade 12 is tense). Thus, displacement of the inner peripheral cutting edge 10 approaches 0. When displacement of the inner peripheral cutting edge 10 approaches 0, the workpiece 22 is again fed to the inner peripheral cutting edge 10. The intermittently cutting shown in FIG. 5 can be performed by repeating these processes. Thus, the semiconductor wafer is cut while correcting the displacement of the inner peripheral cutting edge 10 as shown in FIG. 7. Therefore, the semiconductor wafer is cut smooth.

Figure 8:
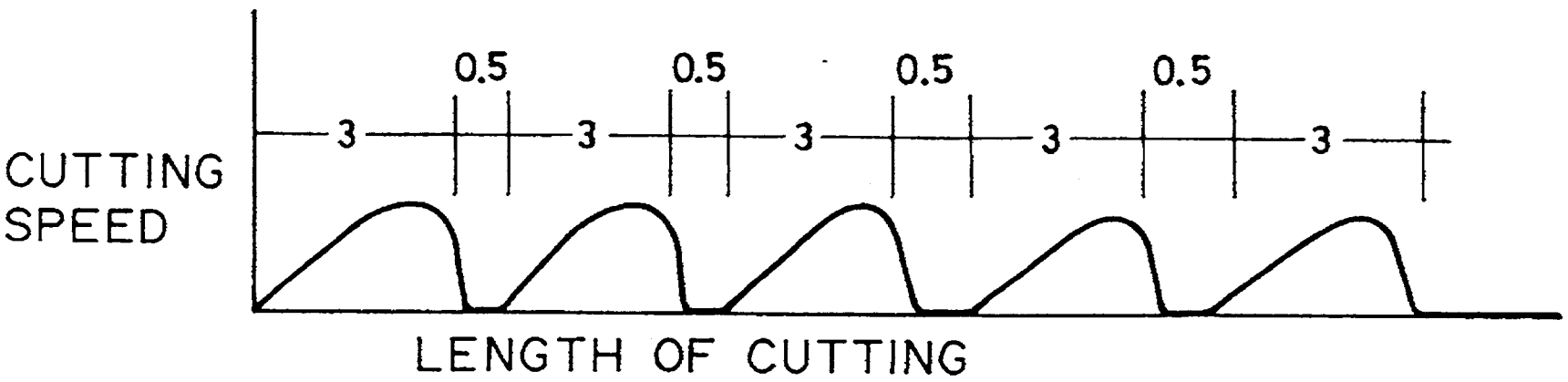
FIG. 8 is an explanatory view showing a cutting speed of an inner peripheral cutting edge according to the second preferred embodiment.

In the above embodiment, the blade sensors 28 and 28 detect the displacement of the blade 12 and the workpiece 22 is cut intermittently. However, the invention is not limited to this. Alternatively, a cut feeding time $T_1$, a stopping time $T_2$ and intermittent rotating time $T_3$ are previously provided. As shown in FIG. 8, for instance, after the workpiece 22 is rotated counterclockwise for $T_1$ (three seconds), it is stopped for $T_2$ (0.5 second) and may be repeated for $T_3$ (11 seconds). Alternatively, after the workpiece 22 is rotated clockwise for $T_1$ (three seconds), it is stopped for $T_2$ (0.5 second) and may be repeated for $T_3$ (11 seconds). With this arrangement, a smooth semiconductor wafer can be manufactured.

Moreover, when the curve displacement of the blade 12 exceeds the predetermined value, the rotating speed of the blade 12 may change, so that the displacement returns within the predetermined value.

Figure 9:
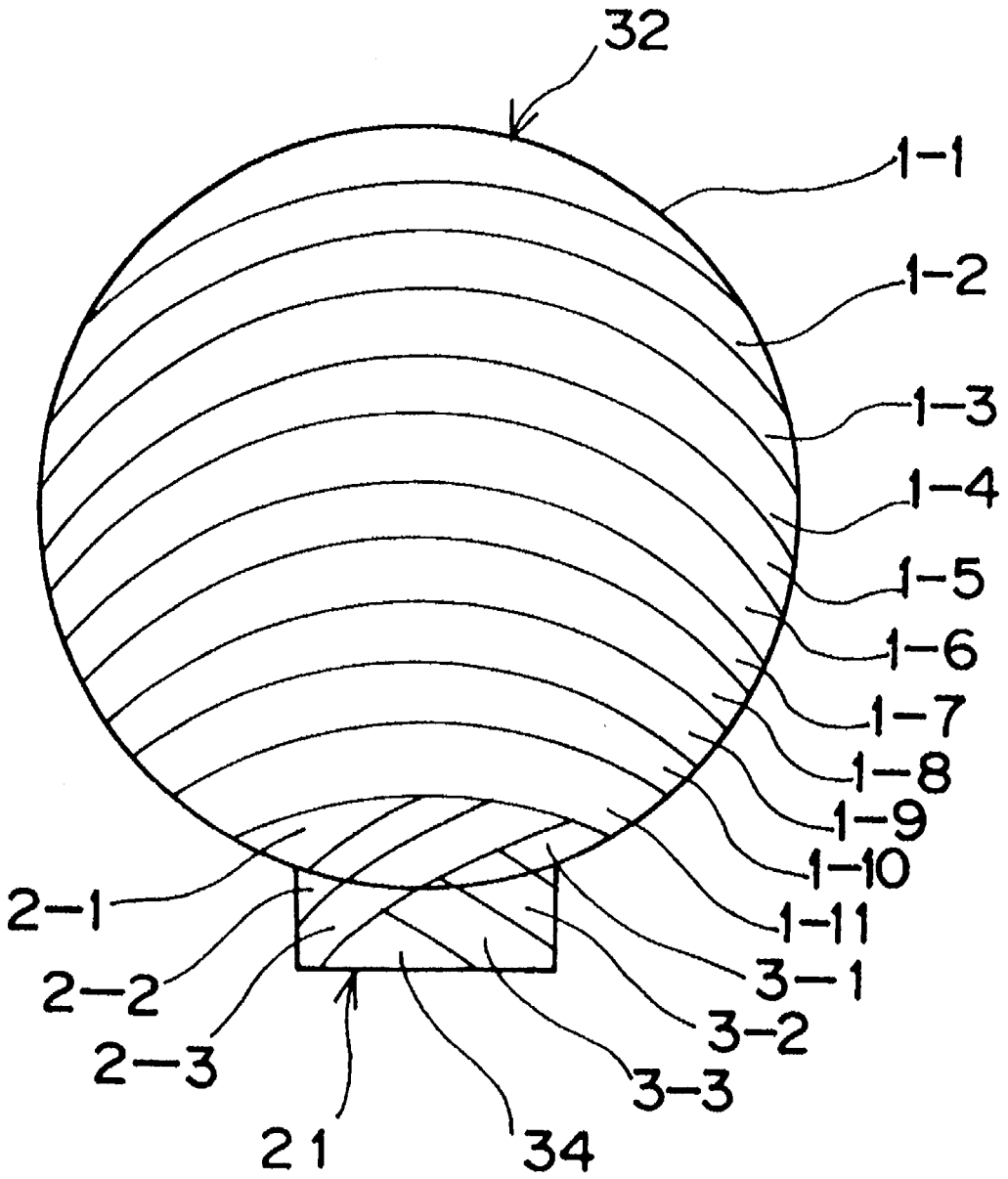
FIG. 9 shows a cutting locus of the semiconductor wafer cut by the apparatus for slicing semiconductor wafer shown in FIG. 1.

In FIG. 9, cut loci from 1-1 to 1-11 are created by moving the trestle 16, shown in FIG. 1, in the direction of arrow B and cutting the semiconductor wafer. Cut loci from 2-1, 2-2 and 2-3 to 3-1, 3-2 and 3-3 are created by rotating the workpiece 22 counterclockwise and clockwise and cutting the semiconductor wafer. Therefore, the effective blade length of the blade 12 can be smaller than the diameter of workpiece 22 by the portion of the rotating cut of a slice base 21. Moreover, the cut remainder part does not remain at the center of the cut semiconductor wafer 32.

Figure 10:
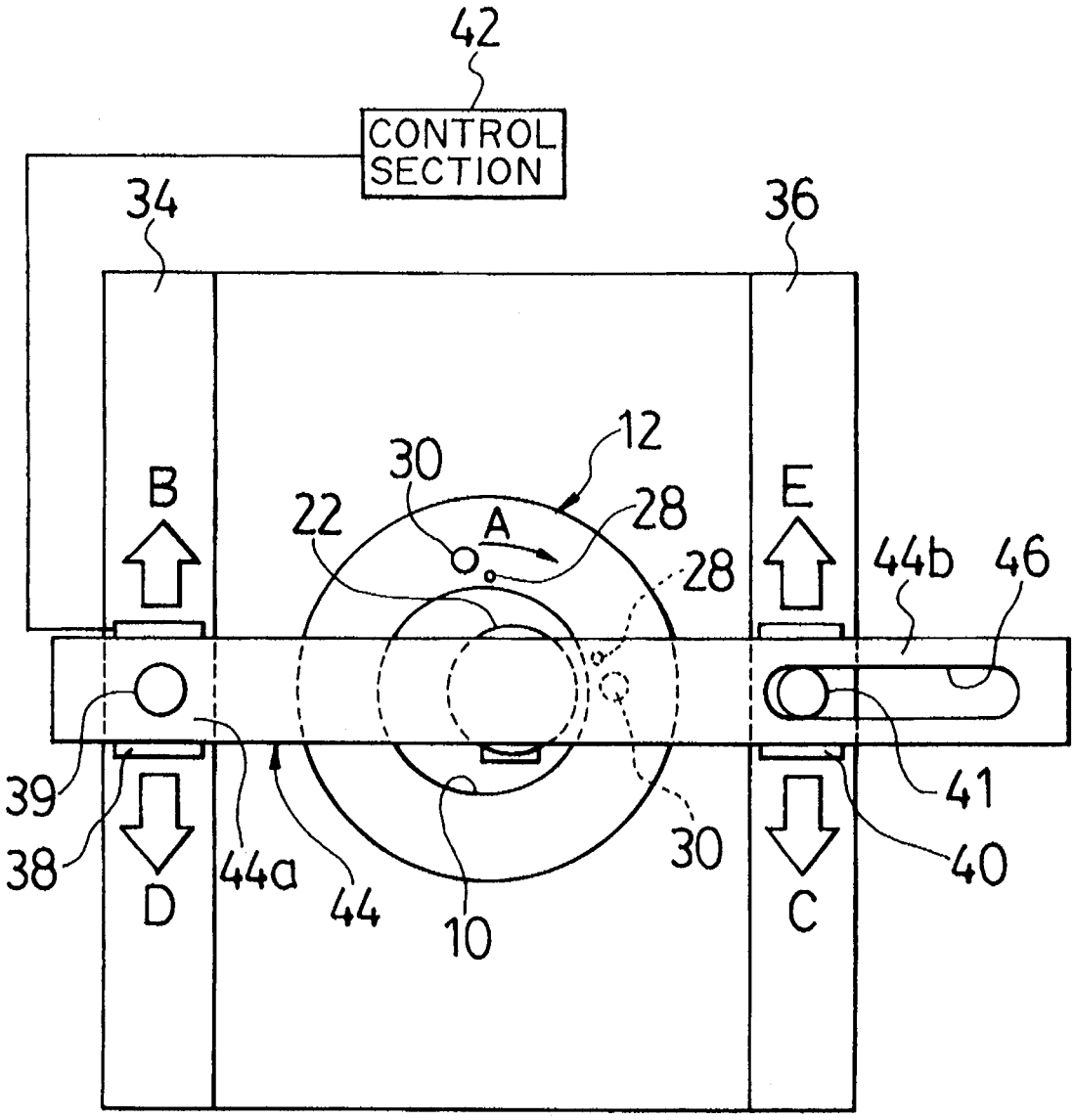
FIG. 10 is an explanatory view showing the second preferred embodiment of an apparatus for slicing semiconductor wafers according to the invention.

FIG. 10 is a second preferred embodiment of the apparatus for slicing semiconductor wafers according to the invention. The same elements as the first embodiment shown in FIG. 1 are assigned the same reference numerals and the explanation thereof is omitted.

The inner peripheral cutting edge 10 is rotable in the direction of arrow A by turning effort of the spindle. Rails 34 and 36 are parallel along both sides of the inner peripheral cutting edge 10.

Sliders 38 and 40 are movably arranged on the rails 34 and 36, respectively. Sliders 38 and 40 are driven by instruction signals from control section 42.

An arm 44 spans between the sliders 38 and 40 and a left end portion 44*a* thereof is rotatably supported by a pin 39 arranged in slider 38. A rectangular hole 46 is formed in a right end portion 44*b* of the arm 44 along the direction of the longer side of the arm 44. A pin 41 arranged in slider 40 is slidably fitted in the rectangular hole 46. With this arrangement, sliders 28 and 40 may move properly such that the arm 44 can rotate on the plane of the inner peripheral cutting edge 10.

Moreover, the workpiece 22 is fixed about the center of the arm and suspended in the inner peripheral portion of the inner peripheral cutting edge 10.

According to the apparatus for slicing semiconductor wafers constructed in the above mentioned manner, the inner peripheral cutting edge 10 is rotated in the direction of arrow A. Then, the workpiece 22 is moved obliquely to be cut by a predetermined value while the slider 38 is moved in the direction of arrow B by control section 42 so that the arm 44 is rotated clockwise and the workpiece 22 is pressed against the grindstone 14 of the inner peripheral cutting edge 10. Next, the remainder part is cut while the slider 40 is moved in the direction of arrow C by the control section 42 so that the arm 44 is rotated clockwise and the workpiece 22 is rotated about the axis thereof by a predetermined value.

Therefore, the effective blade length of the blade 12 can be smaller than the diameter of the workpiece 22. Moreover, the cut remainder part does not remain at the center of the cut semiconductor wafer.

Figure 11:
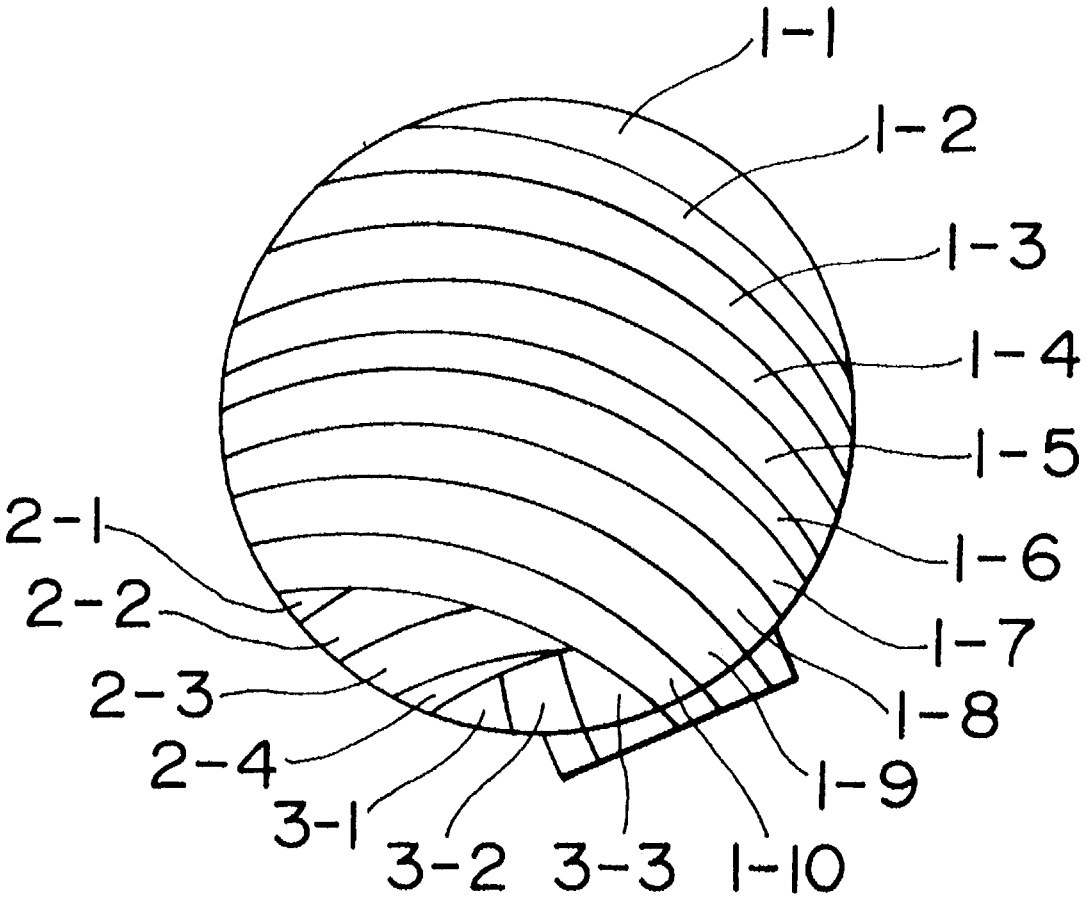
FIG. 11 shows cut loci of the semiconductor wafer cut by the apparatus for slicing semiconductor wafers shown in FIG. 10.

FIG. 11 is an embodiment showing the cut loci on the surface of the semiconductor wafer 32 cut with the above-mentioned apparatus for slicing semiconductor wafers.

In FIG. 11, cut loci from 1-1 to 1-10 are created by moving slider 38, shown in FIG. 10, in the direction of arrow B. Cut loci from 2-1 to 2-4 are created by moving slider 40 in the direction of arrow C and moving slider 38 in the direction of arrow B. Then, cut loci from 3-1 to 3-3 are put on by moving slider 40 in the direction of arrow E and moving slider 38 in the direction of arrow D. Thus, the cut remainder part does not remain at the center of the semiconductor wafer 32.

Figure 12:
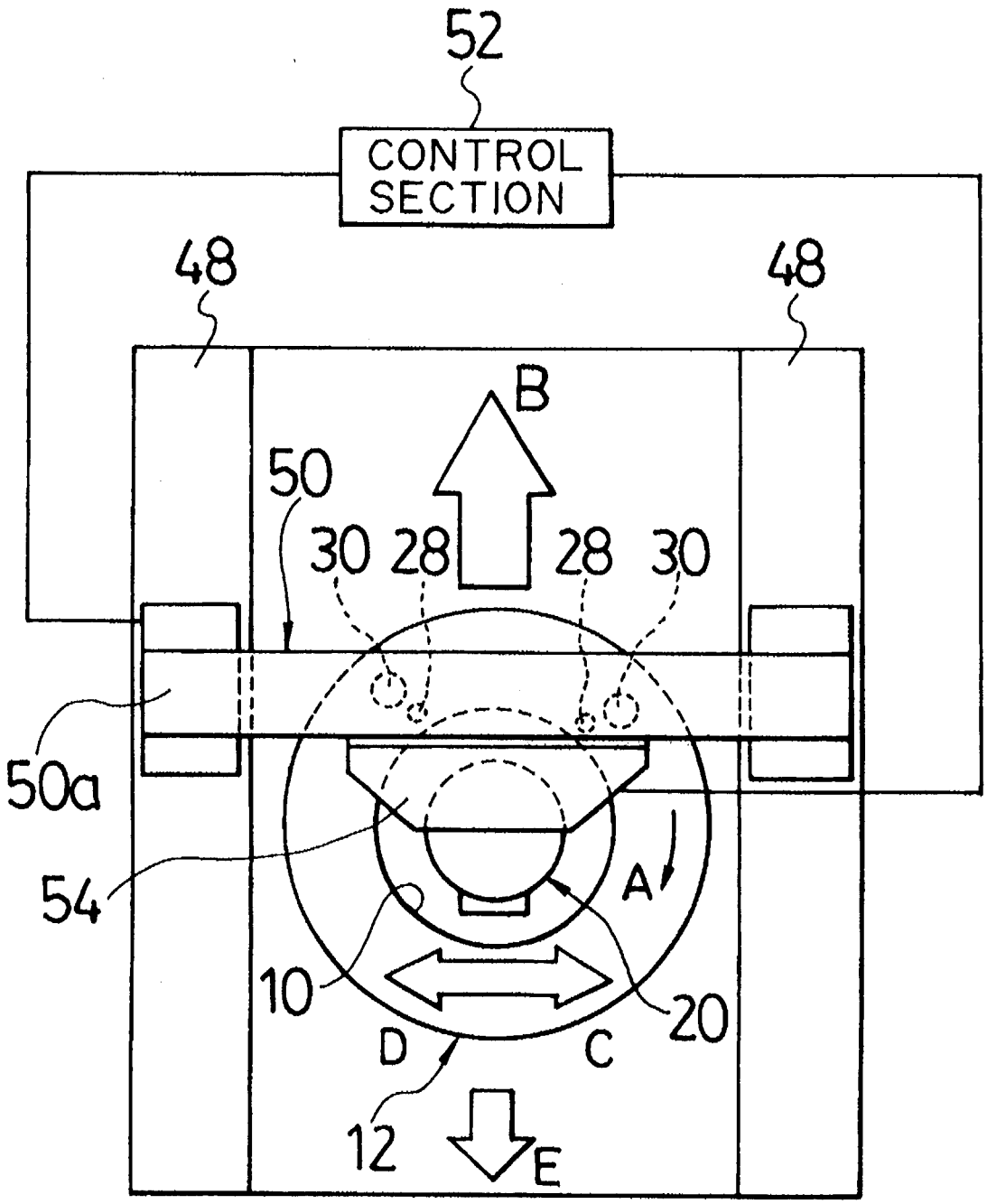
FIG. 12 is explanatory view showing the third preferred embodiment of an apparatus for slicing semiconductor wafers according to the invention.

FIG. 12 is the third preferred embodiment of the apparatus for slicing semiconductor wafers according to the invention. The same elements as the first embodiment shown in FIG. 1 are assigned the same reference numerals and the explanation thereof is omitted.

The inner peripheral cutting edge 10 is rotatable in the direction of arrow A by turning of the spindle. Rails 48 and 48 are parallel along both sides of the inner peripheral cutting edge 10.

An arm 50 spans between the rails 48 and 48. A left end portion 50*a* and right end portion 50*b* of the arm 50 are slidably arranged on rails 48 and 48. Further, the arm 50 is movable in the directions of arrows B and E on the plane of the inner peripheral cutting edge 10 by instruction signals from control section 52.

Moreover, a slide board 54 is slidably attached to the arm 50 along the direction of the longer side of the arm 50. The workpiece 22 is fixed to slide board 54 and suspended in the inner peripheral portion of the inner peripheral cutting edge 10. The slide board 54 is movable in the directions of arrows C and D perpendicularly intersecting the directions of arrows B and E on the plane of the inner peripheral cutting edge 10 by the instruction signals from the control section 52.

According to the apparatus for slicing semiconductor wafers constructed in the above mentioned manner, the inner peripheral cutting edge 10 is rotated in the direction of arrow A. Then, for instance, the workpiece 22 is cut by a predetermined value while the arm 50 is moved in the direction of arrow B by the control section 52 and the workpiece 22 is moved obliquely and pressed against the grindstone 14 of the inner peripheral cutting edge 10. Next, the remainder part is cut by feeding the workpiece 22 in a direction different than the above-mentioned direction.

With this arrangement, the effective blade length of the blade 12 can be smaller than the diameter of the workpiece 22. Moreover, the cut remainder part does not remain at the center of the cut semiconductor wafer.

Figure 13:
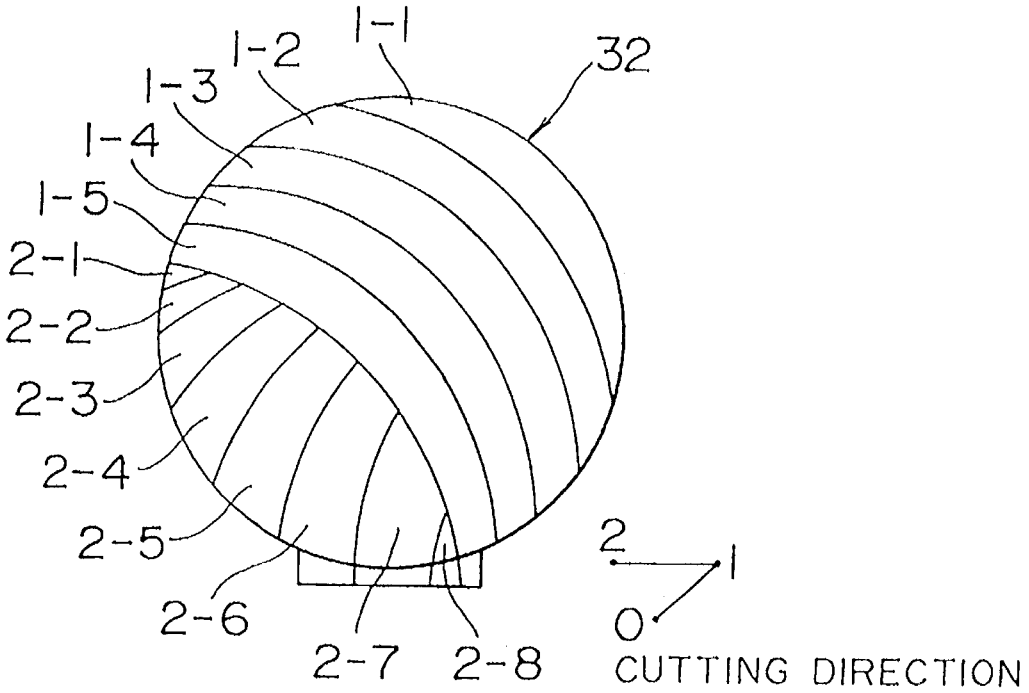
FIG. 13 shows cut loci of the semiconductor wafer cut by the apparatus for slicing semiconductor wafers shown in FIG. 12.
Figure 14:
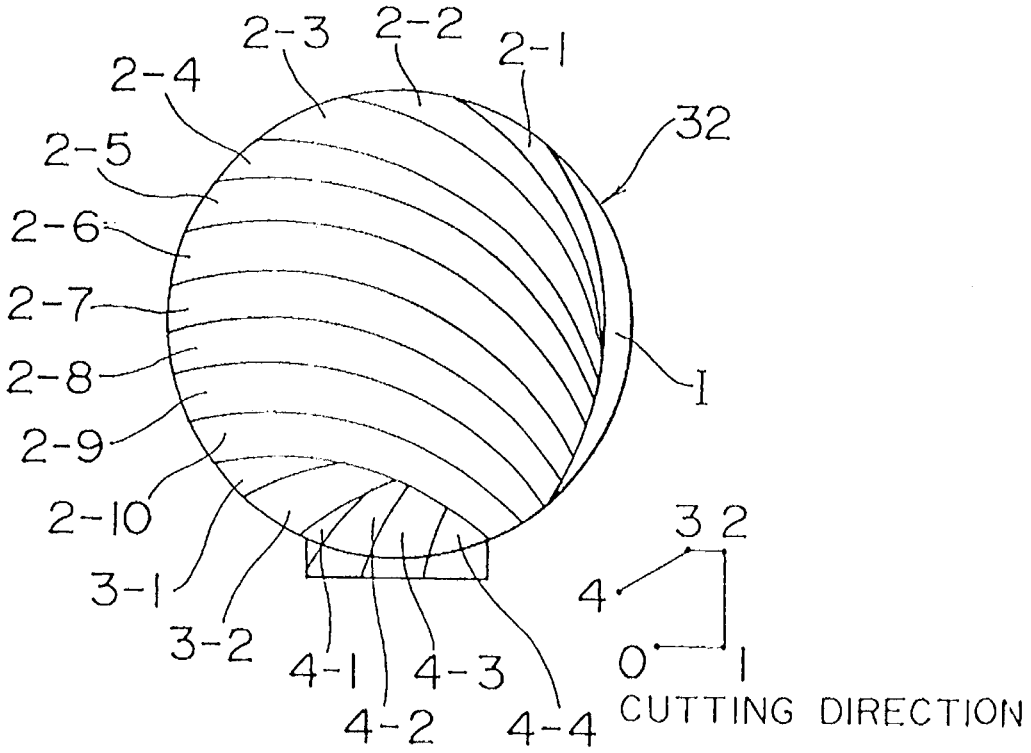
FIG. 14 shows cut loci of the semiconductor wafer cut by the apparatus for slicing semiconductor wafers shown in FIG. 12.
Figure 15:
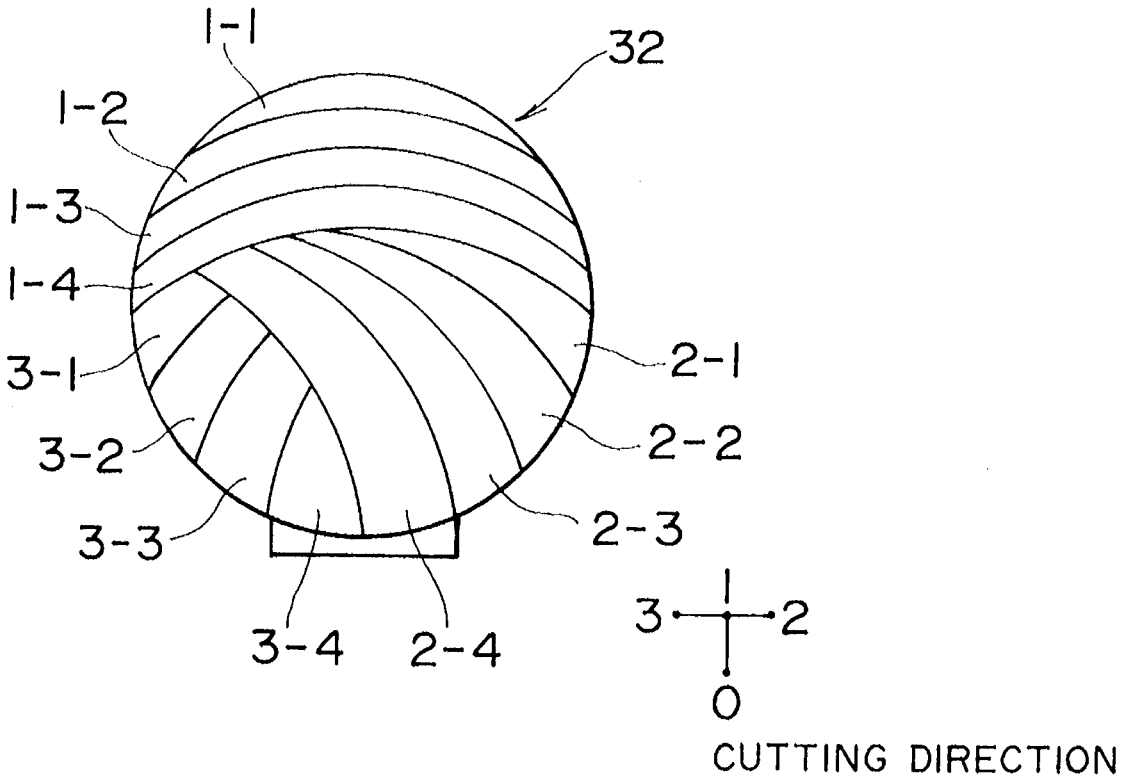
FIG. 15 shows cut loci of the semiconductor wafer cut by the apparatus for slicing semiconductor wafers shown in FIG. 12.

FIGS. 13-15 are embodiments showing the cut loci on surfaces of the semiconductor wafer 32 cut with the above-mentioned apparatus for slicing a semiconductor wafer.

In FIG. 13, cut loci from 1-1 to 1-5 are created by moving slide board 54 in the direction of arrow C and moving the arm 50, shown in FIG. 12, in the direction of arrow B. Cut loci from 2-1 to 2-3 are created by moving slide board 54 in the direction of arrow C. Thus, the cut remainder part does not remain at the center of the semiconductor wafer 32.

In FIG. 14, a cut locus I is created by moving slide board 54 in the direction of arrow C. Cut loci from 2-1 to 2-10 are created by moving arm 50 in the direction of arrow B and cut loci 3-1 and 3-2 are created by moving slide board 54 in the direction of arrow C. Further, cut loci from 4-1 to 4-4 are created by moving slide board 54 in the direction of arrow D and moving arm 50 in the direction of arrow E. Thus, the cut remainder part does not remain at the center of the semiconductor wafer 32.

In FIG. 15, cut loci from 1-1 to 1-4 are made by moving arm 50 in the direction of arrow B and cut loci from 2-1 to 2-4 are made by moving slide board 54 in the direction of arrow C. Further, cut loci from 3-1 to 3-4 are created by moving slide board 54 in the direction of arrow D. Thus, the cut remainder part does not remain at the center of the semiconductor wafer 32.

Figure 16:
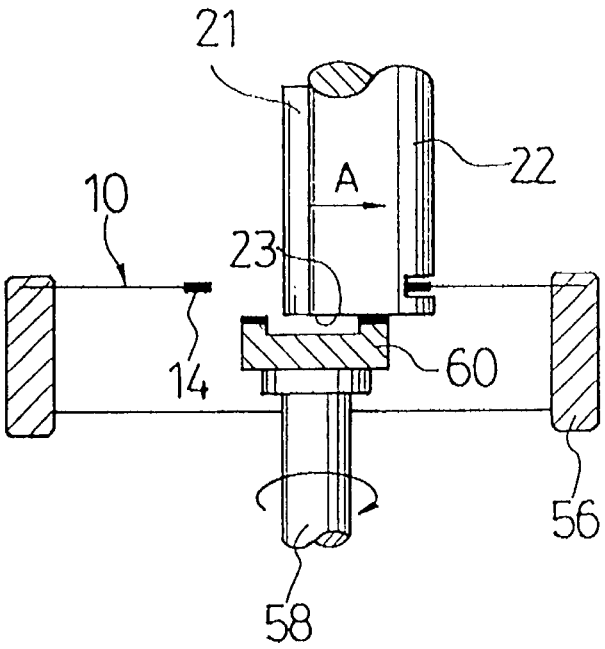
FIG. 16 shows a plane grinding mechanism located in the apparatus for slicing semiconductor wafers.

FIG. 16 shows a mechanism which surface-grinds the end surface of the workpiece 22 in the apparatus for slicing a semiconductor wafer shown in FIGS. 1, 10 and 12. The surface-grinding mechanism surface-grinds differences formed on the surface of the semiconductor wafer manufactured by the apparatus for slicing semiconductor wafers.

In FIG. 16, a grindstone axis 58 is disposed within a hollow spindle 56 and the inner peripheral cutting edge 10 is rotatably and movably disposed within the spindle 56. A grindstone 60 for surface-grinding is arranged at the end of the grindstone axis 58. That is, when the workpiece 22 is being cut, the rotating grindstone 60 contacts an end face 23 of the workpiece 22 and the workpiece 22 or the inner peripheral cutting edge 10 move in a relatively approaching direction (the direction of arrow A) so that the end face 23 is ground by the grindstone 60. Next, the workpiece 22 is cut into a semiconductor wafer by the inner peripheral cutting edge. With this arrangement, the semiconductor wafer is cut from the workpiece 22 and the end face 23 thereof is ground at the same time.

Moreover, since the end face of a slice base 21 need not be ground when the slice base 21 is cut, the surface-grinding operation may be stopped.

Figure 17:
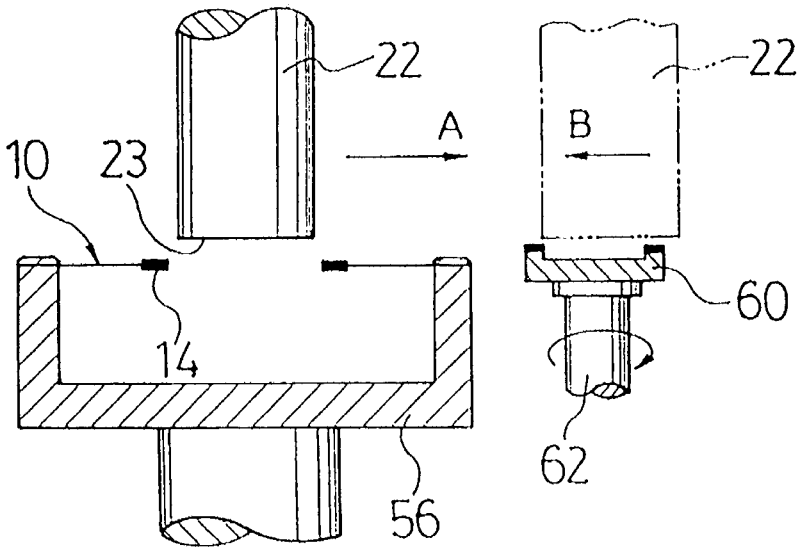
FIG. 17 shows a second plane grinding mechanism located in the apparatus for slicing semiconductor wafers.

FIG. 17 shows another mechanism which surface-grinds in the apparatus for slicing a semiconductor wafer shown in FIGS. 1, 10 and 12.

In FIG. 17, a grindstone 62 is arranged along side of the spindle. The workpiece 22 is cut when the inner peripheral cutting edge 10 moves in the direction of the grindstone axis 62 (the direction of arrow A) and fed in the direction of arrow B and presses against the grindstone 60 so that the end face 23 of the workpiece 22 can be surface-ground.

Thus, the surface-grinding mechanism shown in FIGS. 16 and 17 can be arranged in the apparatus for slicing semiconductor wafers according to the invention. Accordingly, the slicing and the surface-grinding processes of the semiconductor wafer can be performed simultaneously.

Figure 18:
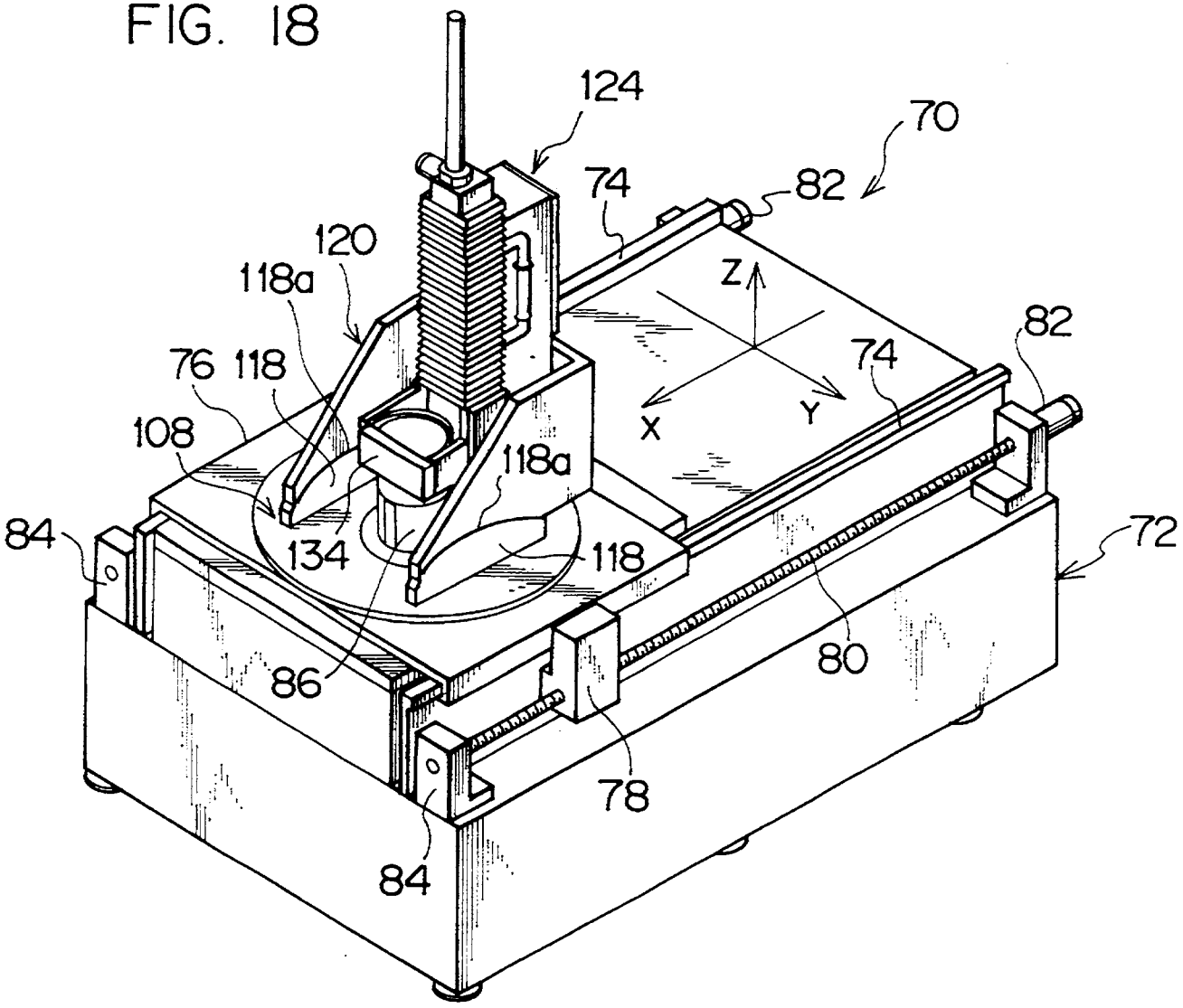
FIG. 18 is a perspective view showing the fourth preferred embodiment of an apparatus for slicing semiconductor wafers according to the invention.
Figure 19:
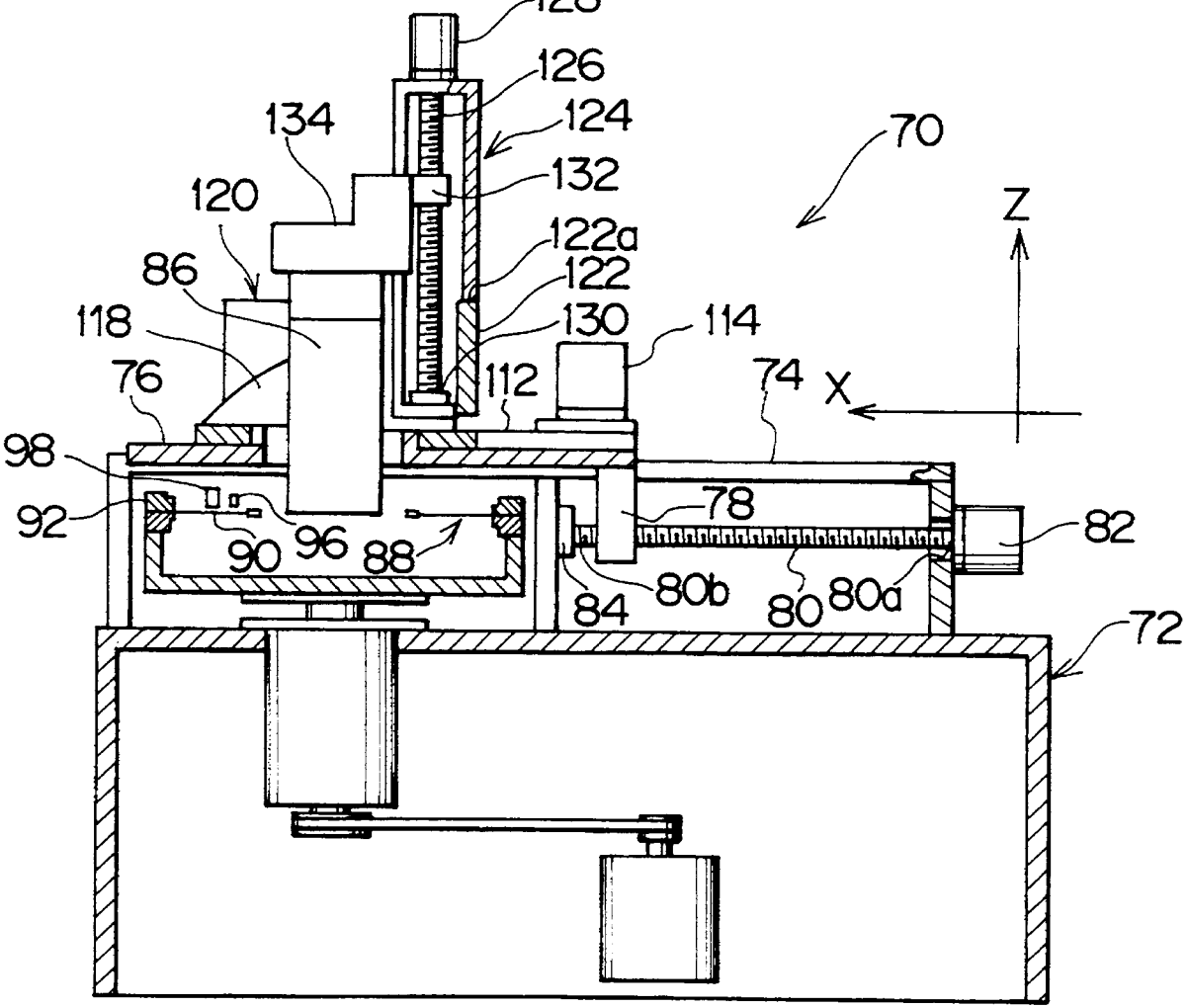
FIG. 19 is a structural section view showing the apparatus for slicing semiconductor wafers shown in FIG. 18.

FIG. 18 is a perspective view showing the fourth preferred embodiment of the apparatus 70 for slicing semiconductor wafers according to this invention and FIG. 19 is a section view thereof.

In the apparatus 70, guide rails 74 and 74 are located along both sides of a trestle 72 in the direction of X in FIG. 18 and a rectangular X-table 76 is mounted movably thereon. A nut 78 for feeding is fastened at the side end portion of the X-table 76 and a screw 80 for feeding arranged in parallel with the guide rail 74 is coupled spirally with the nut 78. The root end portion 80*a* of the screw 80 is connected with a driving motor 82 and the end portion 80*b* is supported with a bearing 84 fastened on a trestle 72.

With this arrangement, the X-table 76 moves along the guide rails 74 and 74 by rotation of the driving motor 82 moving in the cutting direction of a workpiece 86 described below.

An inner peripheral cutting edge 88 and a workpiece 86 are located under the X-table 76. The inner peripheral cutting edge 88 comprises a doughnut-shaped blade 90 whose inner peripheral edge is electro deposited with diamond grains. Further, the inner peripheral cutting edge 88 is stretched out at the outer peripheral edge of the blade 90 by a chuck body 92 and rotated at high speed by a cup-shaped spindle.

A pair of non-contact type blade sensors 96 and 96 and air pads 98 and 98 are arranged on the blade 90. The blade sensors 96 and 96 are connected to a controller (not shown). The controller controls an air pressure control device (not shown) based on the displacement value of the blade 90 detected by the blade sensors 96 and 96 to operate the air pads 98 and 98. Accordingly, the displacement (warp) of blade 90 can be corrected.

Figure 20:
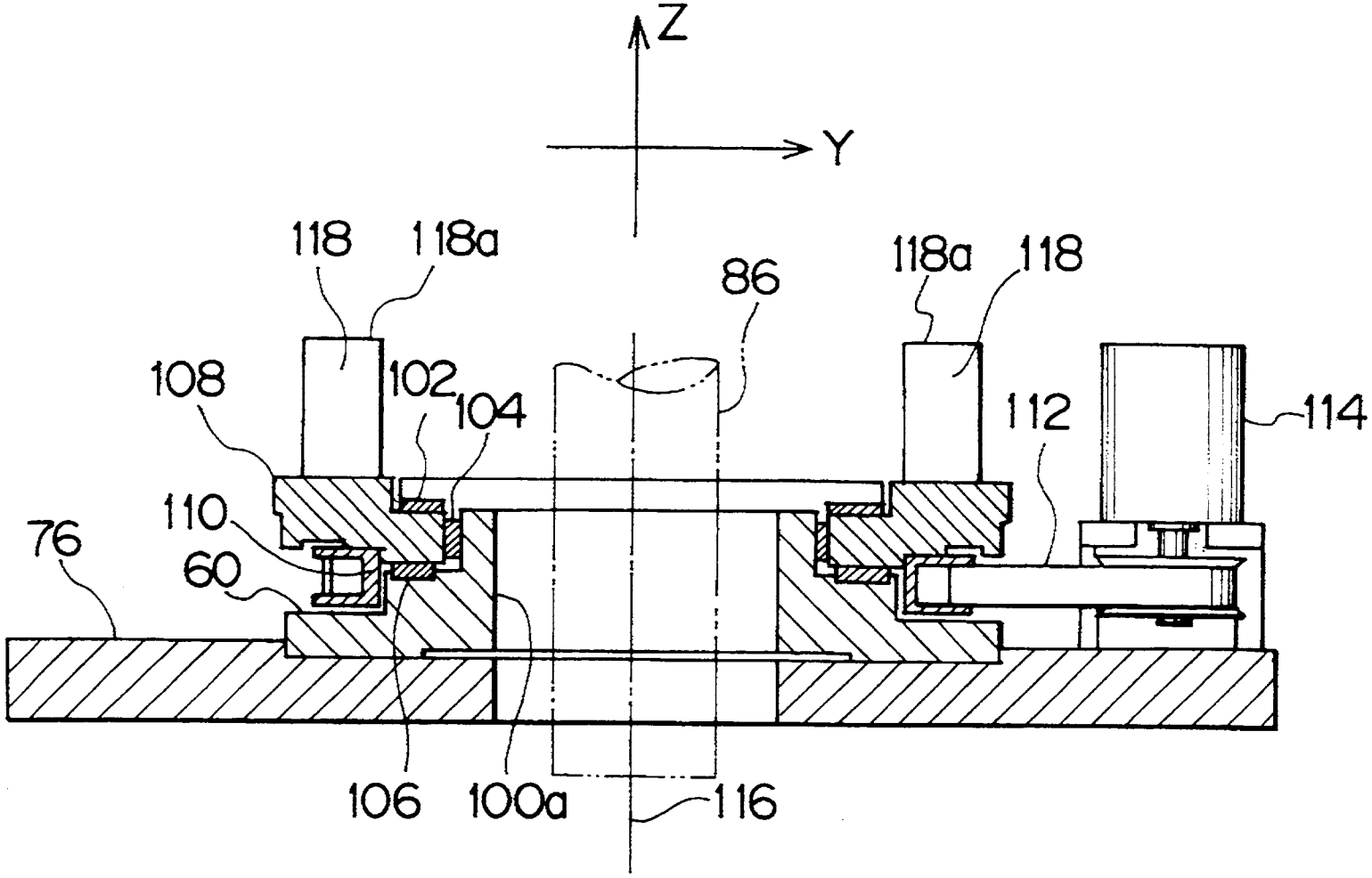
FIG. 20 is section view showing a rotating mechanism applied to the apparatus for slicing semiconductor wafers shown in FIG. 18.

As shown in FIG. 20, a hollow pedestal 100 is fixed to the X-table 76. A disc rotating table 108 is positioned on the pedestal 100 with three sliding rings 102, 104 and 106. The workpiece 86 (shown by the two-dot chain lines in FIG. 20) is disposed within the table 108 and a hollow part 100*a* of the pedestal 100. Further, a pulley 110 is fasten under the rotating table 108. The pulley 110 is connected to a rotating motor 114 through a belt 112 thereby transmitting driving force. Therefore, the rotating motor 114 alternately repeats the normal rotating and the reversing, whereby the rotating table 108 rotates about a center axis 116 of the rotating table 108.

A pair of tilting bases 118 and 118 shaped as semicircular boards are installed on the rotating table 108 as shown in FIG. 18. The tilting base 118 is slidable in the X-direction and positioned at a predetermined position on the surface of the rotating table 108.

A tilting column 120 is slidably mounted on the bow-shaped slide surfaces 118*a* and 118*a* of the tilting bases 118 and 118 shown in FIG. 18. A tilting base 122, shown in FIG. 19, is attached to the tilting column 120. The tilting base 122 is arranged in a direction perpendicular to the tilting base 118, that is, in the Y-direction and a indexing part 124 of the workpiece 86 is slidably mounted on the bow-shaped slide surface 122*a* of the tilting base 122. With this arrangement, the indexing part 124 is tilted by the tilting bases 118 and 118 in the X-direction and by the tilting base 122 in the Y-direction.

The indexing part 124 has an indexing screw 126 arrange in the indexing direction of the workpiece 86 (the Z-direction). A upper end portion of the indexing screw 126 is connected to a driving motor 128 and a lower end portion is supported with a bearing 130 of the indexing part 124. Further, an indexing nut 132 is fastened to the indexing screw 126 and an index head 134 to which the upper end portion of the workpiece 86 is adhered is fastened to the indexing nut 132. Therefore, the driving motor 128 is driven for a predetermined time, so that the workpiece 86 can be indexed to the thickness of one piece of the wafer in the Z-direction.

Next, a description will be given of a method of cutting the wafer with the apparatus 70 for slicing semiconductor wafers constructed in the above mentioned manner.

Figure 21:
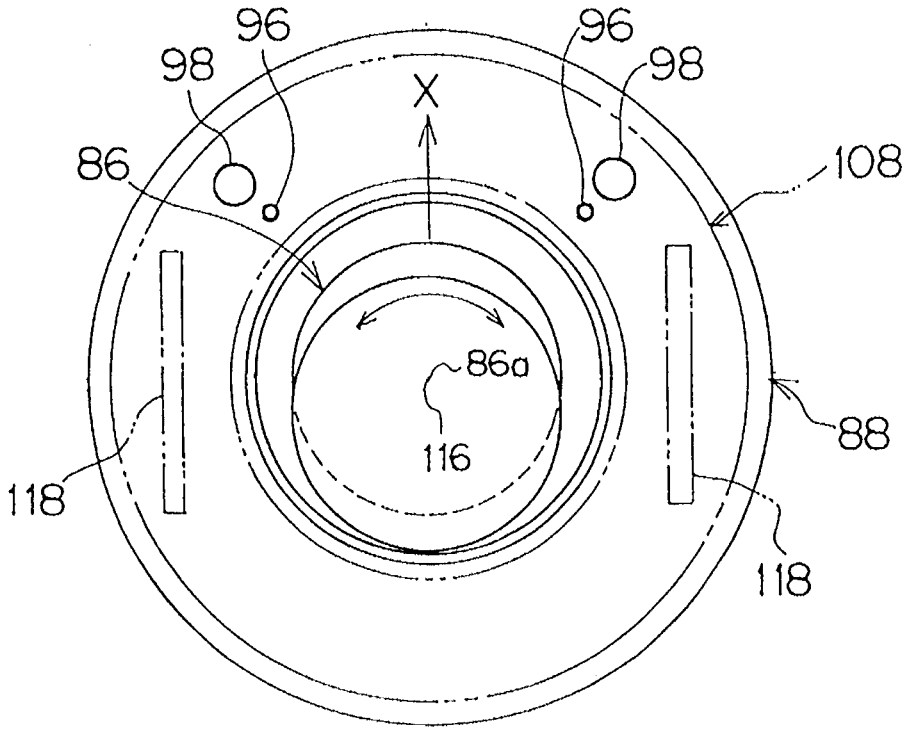
FIG. 21 is an essential plane view showing a cutting surface center of a workpiece that is a rotating fulcrum.
Figure 22:
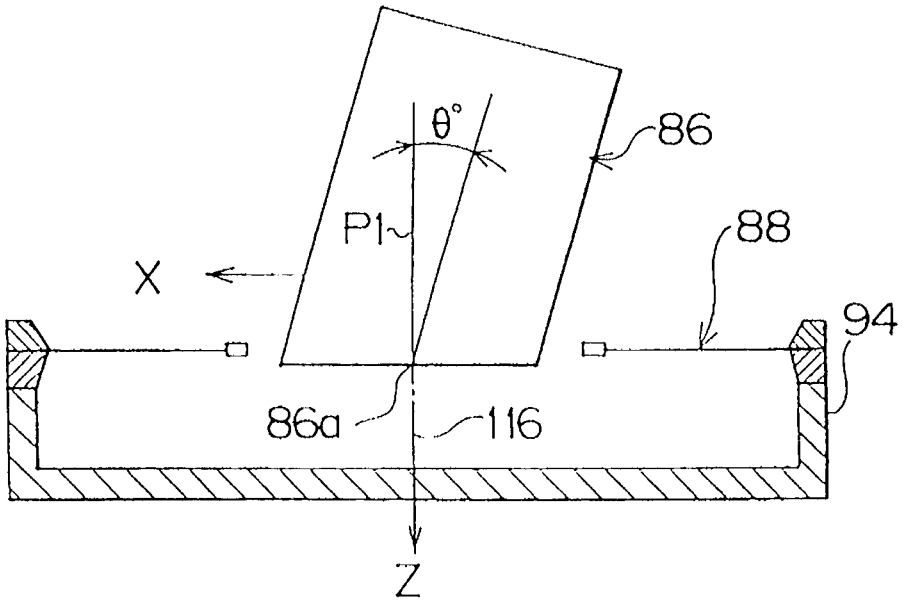
FIG. 22 is a side section view of FIG. 21.

In the first cutting method, the workpiece 86 is tilted along the tilting bases 118 and 120 by an angle Θ° in FIGS. 21 and 22 and wafer is set to be cut along the crystal face of the workpiece 86.

Next, the tilting bases 118 and 118 are positioned on the rotating table 108 such that the center 86*a* in the cutting surface of the workpiece 86 corresponds to the center axis 116 of the rotating table 108.

Thereafter, the driving motor 128 in the indexing part 124, shown in FIG. 19, is driven and the workpiece 86 is fed by the thickness of one piece of the wafer in the Z-direction.

Then, the inner peripheral cutting edge 88 is rotated and the X-table 76 is moved in the X-direction so that the workpiece 86 is pressed against the inner peripheral cutting edge 88.

Further, the rotating motor 114 shown in FIG. 20 is driven to rotate the rotating table 108 by a predetermined value in both directions while the workpiece 86 moves towards the inner peripheral cutting edge 88.

Therefore, according to the first cutting method, the workpiece 86 is cut and rotated about the axis P1 that passes the center 86*a* in the cutting surface and perpendicularly intersects the surface of the blade 90. Thus, the effective blade length of the blade 90 can be smaller than the diameter of the workpiece 86. Moreover, the cut remainder part does not remain at the center of the cut semiconductor wafer.

Figure 23:
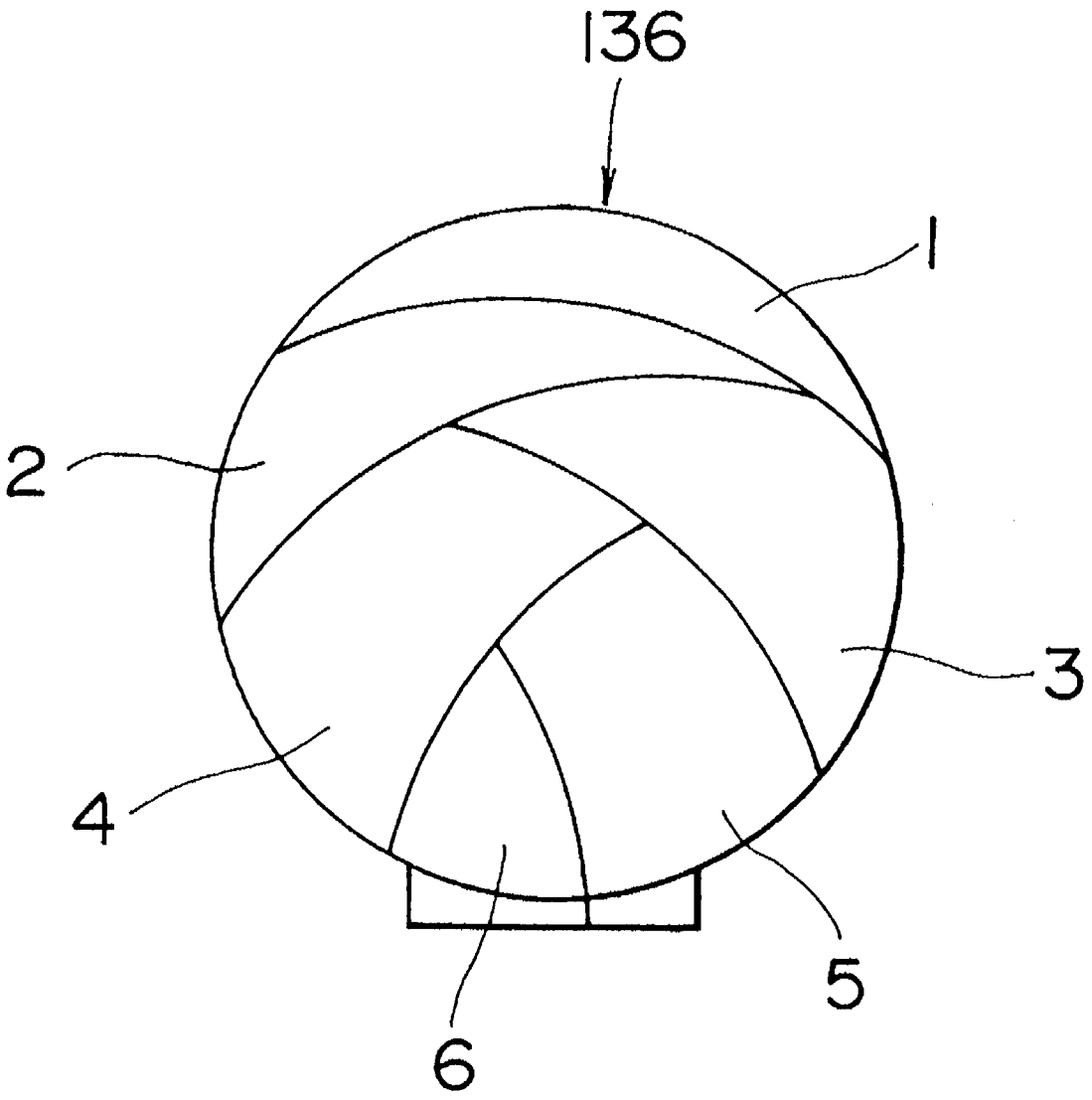
FIG. 23 shows cut loci of the semiconductor wafer cut by the apparatus for slicing semiconductor wafers shown in FIG. 18.

FIG. 23 is an embodiment showing cut loci on the surface of the semiconductor wafer 136 cut according to the first cutting method.

In FIG. 23, the cut loci from 1 to 6 are made by rotating the workpiece 86, shown in FIG. 22, about the center 86*a* in the cutting surface thereof and feeding the workpiece 86 in the X-direction. Therefore, the cut remainder part as shown in FIG. 23 does not remain at the center of the semiconductor wafer 136.

Moreover, when the intermittent cutting is performed using the first cutting method, the semiconductor wafer 136 having the cut loci shown in FIG. 5 can be manufactured.

Alternatively, the feeding and stopping operations may be controlled according to the displacement of the blade 90, or a feeding time $T_1$, a stopping time $T_2$ and an intermittent rotating time $T_3$ are predetermined, whereby an intermittent cutting shown in FIG. 8 may be performed. Thus, a smooth semiconductor wafer 136 can be manufactured.

Further, when the displacement (warp) of the blade 90 exceeds a predetermined value, the rotating speed changes so that the displacement returns within the predetermined value.

Hereafter, the second cutting method will be explained.

Figure 24:
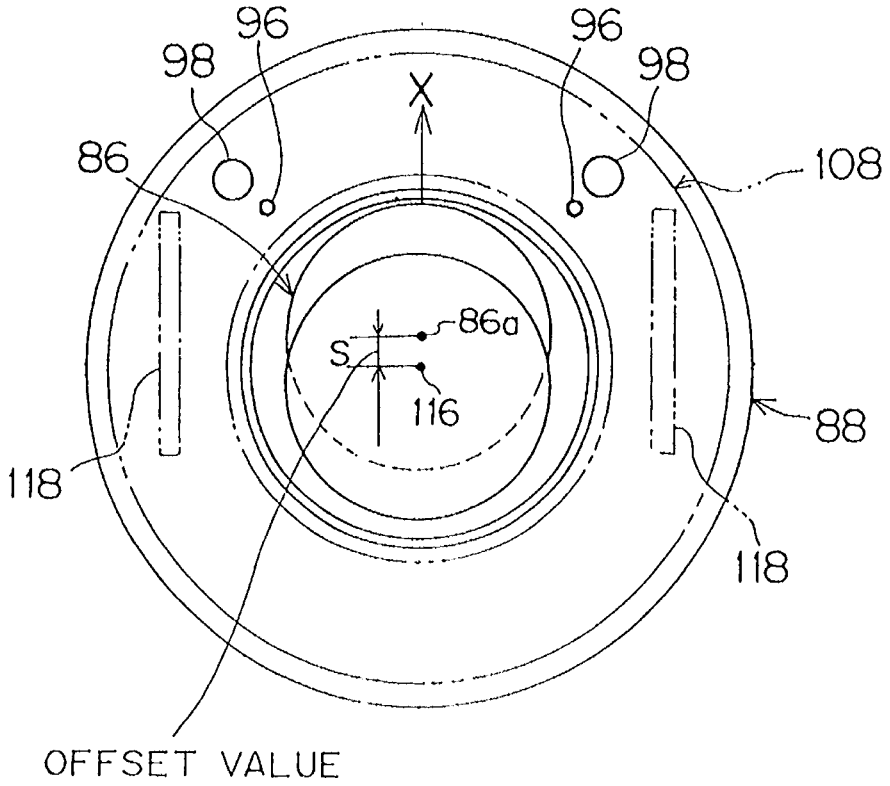
FIG. 24 is an essential plane view showing a position shifted from a cutting surface center of a workpiece that is rotating fulcrum.
Figure 25:
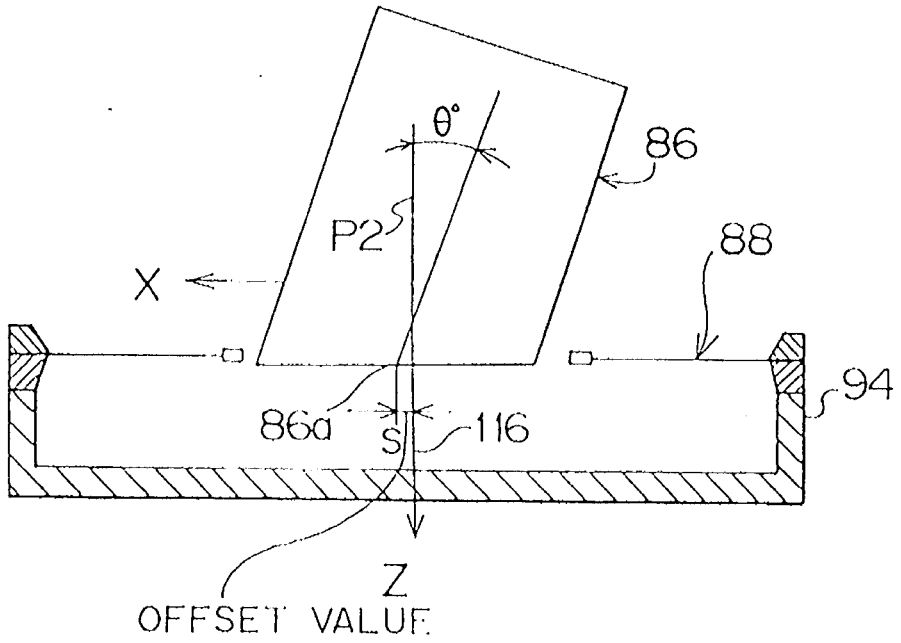
FIG. 25 is a side section view of FIG. 24.

First, the workpiece 86 is tilted by the titling bases 118 and 120 by an angle Θ° shown in FIGS. 24 and 25 and the wafer is set to be cut along the crystal face of the workpiece 86.

Next, the tilting bases 118 and 118 move by a predetermined value from the position of FIG. 21 in the X-direction, so that the center 86*a* of the workpiece 86 is shifted by an offset value, S, from the center axis 116 of the rotating table 108 in the X-direction.

Thereafter, the driving motor 128 on the indexing part 124, shown in FIG. 19, is driven and the workpiece 86 is fed by the thickness of one piece of the wafer in the Z-direction.

Then, the inner peripheral cutting edge 88 is rotated and the-X table 76 is moved in the X-direction so that the workpiece 86 is pressed against the inner peripheral cutting edge 88.

Then, the rotating motor 114, shown in FIG. 20, is driven to rotate the rotating table 108 by the predetermined value in both directions while the workpiece 86 approaches the inner peripheral cutting edge 88.

Thus, according to second cutting method, the workpiece 86 is cut and rotated about the axis P2 passing through a position shifted from the center 86*a* in the cutting surface thereof and perpendicularly intersecting the surface of the blade 90, so that the effective blade length of the blade 90 can be smaller than the diameter of the workpiece 86 as in the first cutting method. Moreover, the cut remainder part does not remain at the center of the cut semiconductor wafer.

Figure 26:
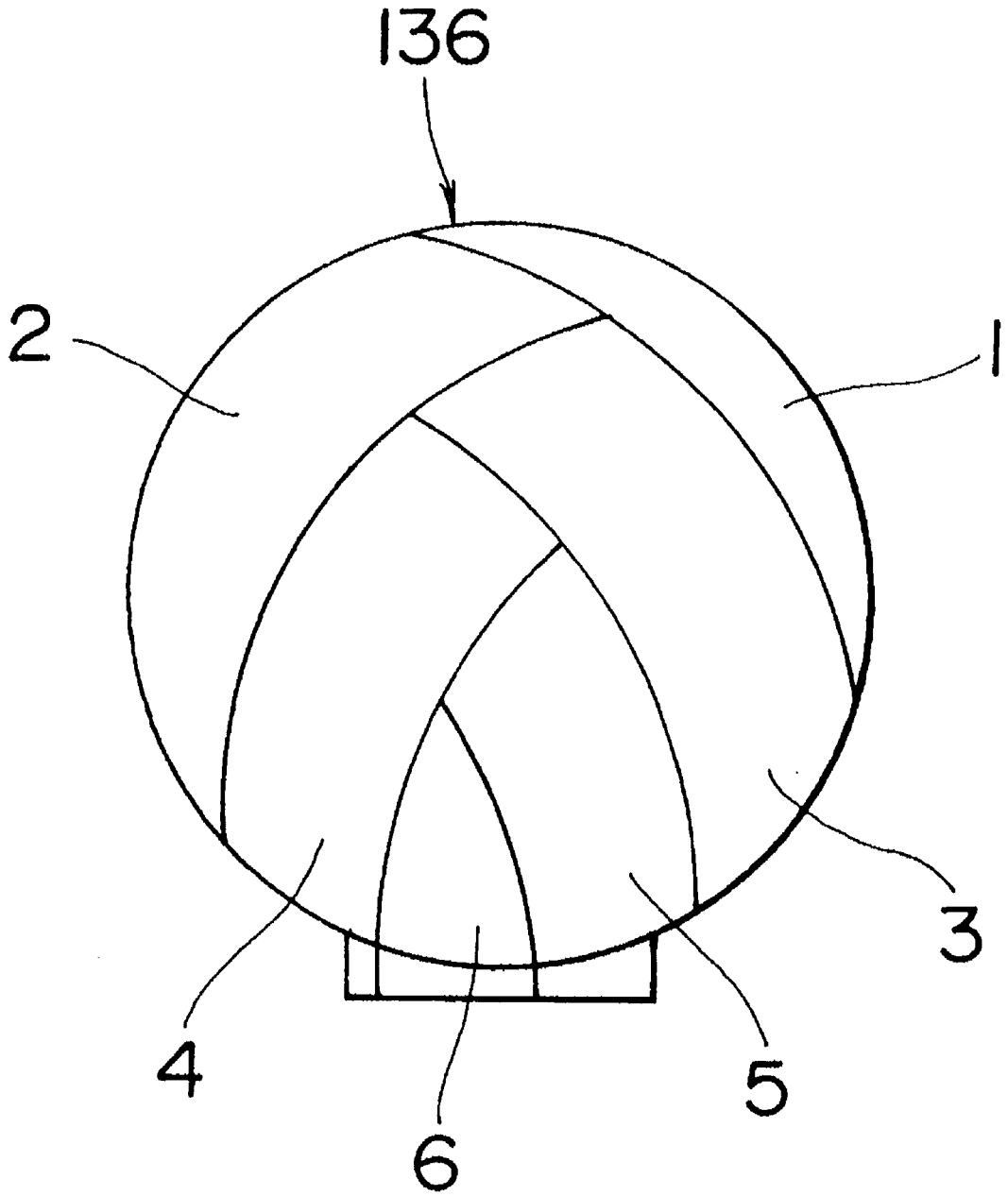
FIG. 26 shows cut loci of the semiconductor wafer cut by the apparatus for slicing semiconductor wafers shown in FIG. 18.

FIG. 26 is an embodiment showing the cut loci on surface 136 of the semiconductor wafer cut according to the second cutting method.

In FIG. 26, the cut loci from 1 to 6 are created by rotating the workpiece 86, shown in FIG. 25, about the position shifted from the center 86*a* of the cutting surface thereof by the offset value, S, and feeding the workpiece 86 in the X-direction. Therefore, the cut remainder part, as shown in FIG. 26, does not remain at the center of the semiconductor wafer 136.

Moreover, when the intermittent cutting is performed using the second cutting method, the semiconductor wafer 136 having the cut loci shown in FIG. 5 can be manufactured.

Alternatively, the feeding and stopping operations may be controlled according to the displacement of the blade 90, or a feeding time $T_1$, a stopping time $T_2$ and an intermittent rotating time $T_3$ are predetermined, whereby intermittent cutting shown in FIG. 8 may be performed. Thus, a smooth semiconductor wafer 136 can be manufactured.

Further, when the displacement (warp) of the blade 90 exceeds a predetermined value, the rotating speed changes so that the displacement returns within the predetermined value.

Figure 27:
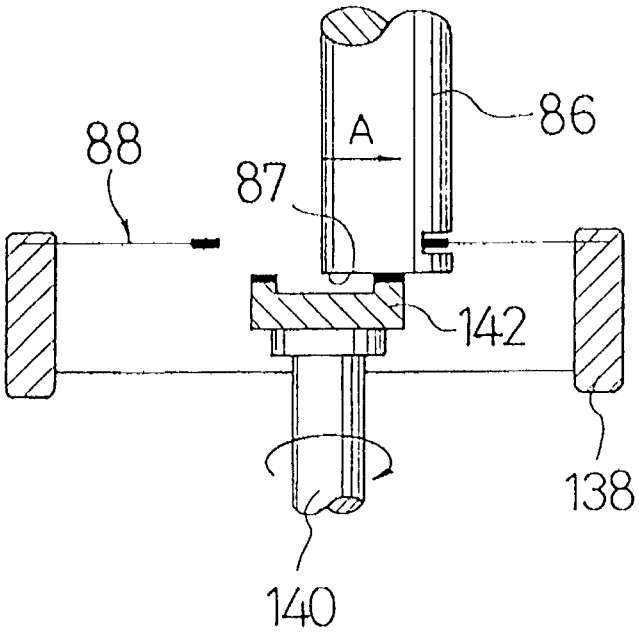
FIG. 27 shows a plane grinding mechanism located in the apparatus for slicing semiconductor wafers shown in FIG. 18.

FIG. 27 is the first embodiment showing a mechanism that surface-grinds the end surface of the workpiece 86 in the apparatus 70 for slicing semiconductor wafers shown in FIG. 18. The surface-grinding mechanism surface-grinds differences formed on the surface of the semiconductor wafer manufactured by the apparatus 70.

In FIG. 27, the inner peripheral cutting edge 88 is disposed within a hollow spindle 138 and a grindstone axis 140 is disposed within spindle 138. The grindstone axis 140 is rotatable and movable with spindle 138. rotated and movable with the spindle 56. A grindstone 142 for surface-grinding is arranged at the end of grindstone axis 140. That is, when the wafer of workpiece 86 is being cut, the rotating grindstone 142 is presses against an end face 87 of the workpiece 86 and the workpiece 86 or the inner peripheral cutting edge 88 move in a relatively approaching direction (the direction of arrow A) so that the end face 87 is ground by the grindstone 142. Next, the workpiece 86 is cut into a semiconductor wafer by the inner peripheral cutting edge. With this arrangement, the semiconductor wafer is cut from the workpiece 86 and the end face 87 thereof is ground at the same time.

Figure 28:
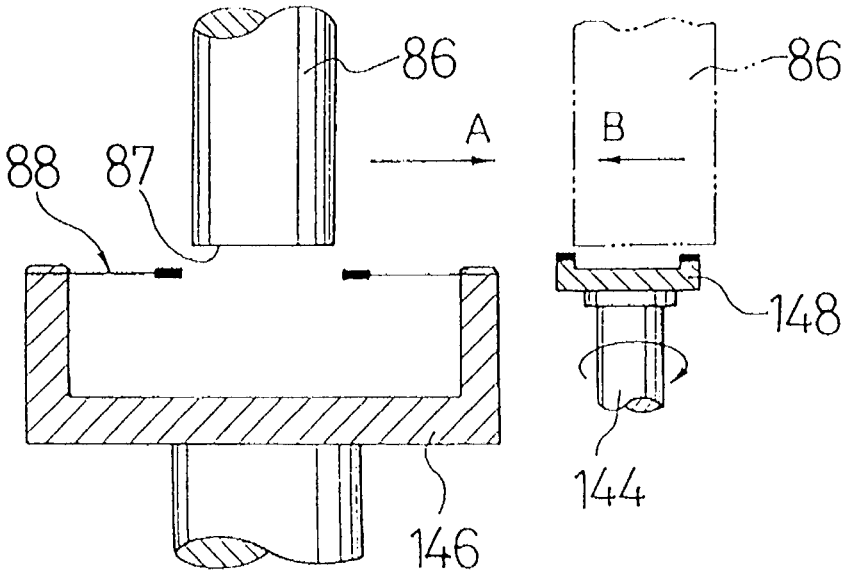
FIG. 28 shows a second plane grinding mechanism located in the apparatus for slicing semiconductor wafers shown in FIG. 18.
Figure 29:
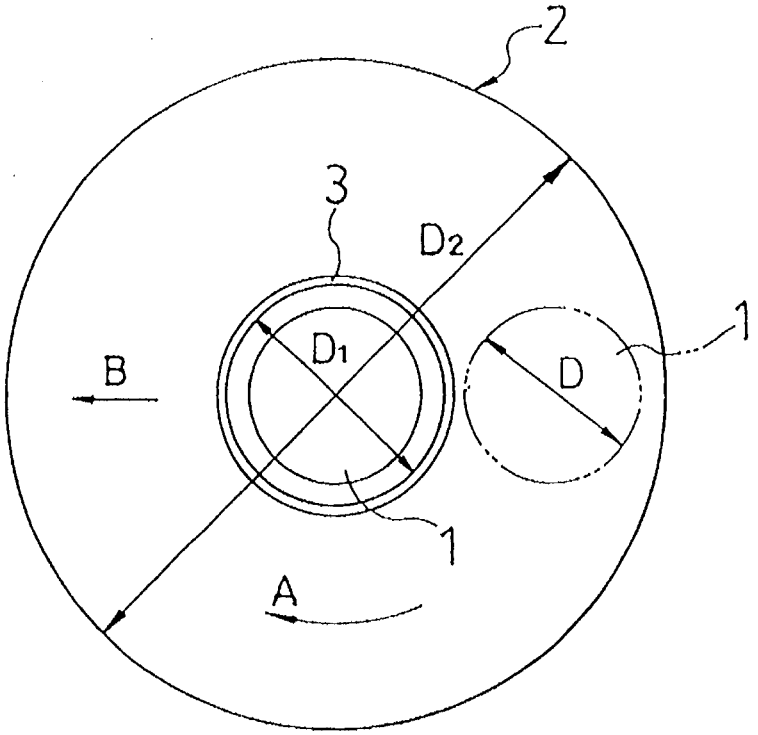
FIG. 29 is an explanatory view showing a first conventional method of slicing semiconductor wafers.
Figure 30:
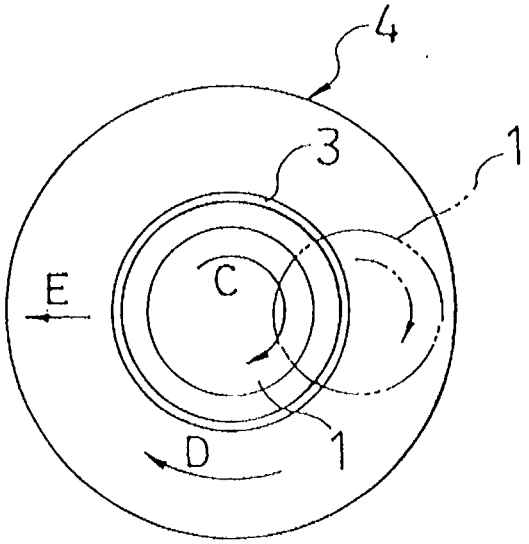
FIG. 30 is an explanatory view showing a second conventional method of slicing semiconductor wafers.

FIG. 28 is a second embodiment showing a surface-grinding mechanism in the apparatus for slicing a semiconductor wafer.

The workpiece 86 to be cut by the inner peripheral cutting edge 88 is moved in the direction of the grindstone axis 144 (the direction of arrow A) and then fed in the direction of arrow B to press against the grindstone 148 so that the end face 87 of the workpiece 86 can be surface-ground.

Thus, the surface grinding mechanism shown in FIGS. 27 and 28 can be arranged in the apparatus 70 for slicing a semiconductor wafer according to the invention. Accordingly, the slicing and the surface-grinding processes of the semiconductor wafer can be performed simultaneously.

According to the first preferred method for slicing semiconductor wafers as explained above, the semiconductor material presses against the rotating inner peripheral cutting edge and at least one of the inner peripheral cutting edge and the semiconductor material moves in opposite approaching directions by the predetermined value so that the semiconductor material is cut by the predetermined value. Then, the semiconductor material rotates about the axis thereof so that the remainder part can be cut off. Therefore, the effective blade length of the blade can be smaller than the diameter of the semiconductor material and the remainder part does not remain at the center of the semiconductor wafer.

According to the second preferred method for slicing semiconductor wafers, the semiconductor material is moves obliquely to an advancing direction thereof to be cut. Therefore, the effective blade length of the blade can be smaller than the diameter of the semiconductor material and the cut remainder part does not remain at the center of the cut semiconductor wafer.

According to the first preferred apparatus for slicing semiconductor wafers, the moving means is driven by the control means and at least one of the inner peripheral cutting edge and the semiconductor material move in opposite approaching directions so that the semiconductor material can be cut by the predetermined value. Then, the rotating means is driven by the control means and the semiconductor material is rotated about the axis thereof so that the remainder part can be cut off. Therefore, the effective blade length of the blade can be smaller than the diameter of the semiconductor material and the remainder part does not remain at the center of the semiconductor wafer.

According to the second preferred apparatus for slicing semiconductor wafers, the first and second sliders are driven by the control means to rotate the arm and the semiconductor material is rotated about the axis thereof to be cut. Therefore, the effective blade length of the blade can be smaller than the diameter of the semiconductor material and the remainder part does not remain at the center of the semiconductor wafer.

According to the third preferred apparatus for slicing semiconductor wafers, the arm and slidable member are driven by the control section and the semiconductor material moves in the X- and Y- directions on the plane of the inner peripheral cutting edge to be cut. Therefore, the effective blade length of the blade can be smaller than the diameter of the semiconductor material and the remainder part does not remain at the center of the semiconductor wafer.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method of slicing a semiconductor wafer, comprising the steps of:

rotating an inner peripheral cutting edge formed on an inner peripheral edge of a doughnut-shaped blade;

rotating said semiconductor material to a first oblique angle with respect to an advancing direction of said semiconductor material and then moving said semiconductor material in the advancing direction while pressing said semiconductor material against the inner peripheral cutting edge; and rotating said semiconductor material to a second oblique angle with respect to the advancing direction and then moving said semiconductor material in the advancing direction while pressing said semiconductor material against the inner peripheral cutting edge.

2. An apparatus for slicing a semiconductor wafer, wherein an inner peripheral cutting edge formed on an inner peripheral edge of a doughnut-shaped blade is rotated and a columnar semiconductor material is pressed on the inner peripheral cutting edge, comprising:

a pair of rails parallel to each other and positioned on opposite sides of said inner peripheral cutting edge;

first and second sliders movably mounted on said pair of rails;

an arm having a first end and a second end, the first end being rotatably supported by said first slider and the second end being movably secured to said second slider, the arm being rotatable on a planar surface of said inner peripheral cutting edge by moving said first and second sliders, and the arm having a substantially central portion on which said semiconductor material is suspended towards said inner peripheral cutting edge; and a control section for driving said first and second sliders.

3. An apparatus for slicing a semiconductor wafer, wherein an inner peripheral cutting edge formed on an inner peripheral edge of a doughnut-shaped blade is rotated and a columnar semiconductor material is pressed on the inner peripheral cutting edge, comprising:

a pair of rails parallel to each other and positioned on opposite sides of said inner peripheral cutting edge in a direction X;

an arm having a left end portion and a right end portion, said arm spanning across said pair of rails in a direction Y, the left end portion and right end portion being movably secured to said pair of rails, said arm being movable on a planar surface of said inner peripheral cutting edge;

a slidable member movable in the direction Y along the arm, said slidable member having said semiconductor material being suspended towards said inner peripheral cutting edge; and a control section for driving said arm and said slidable member.

4. A method of slicing a semiconductor wafer, comprising the steps of:

rotating an inner peripheral cutting edge formed on an inner peripheral edge of a doughnut-shaped blade;

inclining said semiconductor material in a first direction and a second direction with respect to a surface of the blade by a predetermined angle; and rotating said semiconductor material to a predetermined angle and then moving at least one of said peripheral cutting edge and said semiconductor material relatively closer to each other by a predetermined value to perform a cutting operation.

5. The method of slicing a semiconductor wafer as set forth in claim 4, wherein said semiconductor material is rotated about an axis passing through a center of a cut surface of said semiconductor material and perpendicularly intersecting said surface of the blade.

6. The method of slicing a semiconductor wafer as set forth in claim 4, wherein said semiconductor material is rotated about an axis passing through a position shifted from a center of a cut surface of said semiconductor material and perpendicularly intersecting said surface of the blade.

7. A method of slicing a semiconductor wafer, comprising the steps of:

rotating an inner peripheral cutting edge formed on an inner peripheral edge of a doughnut-shaped blade;

moving at least one of the inner peripheral cutting edge and the semiconductor material relatively closer to each other by a predetermined value;

(1) rotating said semiconductor material in a first direction to a first predetermined angle, moving at least one of the inner peripheral cutting edge and the semiconductor material relatively closer to each other to perform a first cutting operation for a predetermined time $T_1$, thereafter, stopping the first cutting operation for a predetermined time $T_2$, and repeating said first cutting operation and stop first cutting operation for a predetermined time $T_3$;

(2) rotating said semiconductor material in a second direction to a second predetermined angle, moving at least one of the inner peripheral cutting edge and the semiconductor material relatively closer to each other to perform a second cutting operation for a predetermined time $T_1$, thereafter, stopping the second cutting operation for a predetermined time $T_2$, and repeating said second cutting operation and stopping said second cutting operation for a predetermined time $T_3$; and repeating steps (1) and (2).

8. The method of slicing a semiconductor wafer as set forth in claim 7, wherein said semiconductor material is rotated about an axis of said semiconductor material.

9. The method of slicing a semiconductor wafer as set forth in claim 7, wherein said semiconductor material is inclined to a surface of the blade by a predetermined angle and rotated about an axis passing through a center of a cut surface of said semiconductor material and perpendicularly intersecting the surface of the blade.

10. The method of slicing a semiconductor wafer as set forth in claim 7, wherein said semiconductor material is inclined to a surface of the blade by a predetermined angle and rotated about an axis passing through a position shifted from a center of a cut surface of said semiconductor material by a predetermined value and perpendicularly intersecting the surface of the blade.

11. A method of slicing a semiconductor wafer, comprising the steps of:

rotating an inner peripheral cutting edge formed on an inner peripheral edge of a doughnut-shaped blade;

moving at least one of said inner peripheral cutting edge and said semiconductor material relative to each other by a predetermined value while performing a cutting operation; and rotating the semiconductor material about an axis in counterclockwise and clockwise directions by a predetermined value to cut a slice base of semiconductor material.

12. An apparatus for slicing a semiconductor wafer, wherein an inner peripheral cutting edge formed on an inner peripheral edge of a doughnut-shaped blade is rotated and a columnar semiconductor material is pressed on the inner peripheral cutting edge, comprising:

moving means for intermittently moving at least one of the inner peripheral cutting edge and the semiconductor material relatively closer to each other;

rotating means for rotating the semiconductor material in a counterclockwise direction by a predetermined angle and in a clockwise direction by a predetermined angle, alternately; and control means for driving said moving means and said rotating means.

13. The apparatus for slicing a semiconductor wafer as set forth in claim 12, wherein said rotating means rotates said semiconductor material about an axis thereof.

14. The apparatus for slicing a semiconductor wafer as set forth in claim 13, further comprising grinding means for grinding at least one of the semiconductor wafer while being cut and a planar surface of the semiconductor wafer after being cut.

15. The apparatus for slicing a semiconductor wafer as set forth in claim 12, further comprising tilting means for inclining said semiconductor material to a surface of the blade by a predetermined angle, and said rotating means rotates about an axis passing through a center of a cut surface of said semiconductor material and perpendicularly intersects the surface of the blade and rotates said semiconductor material in a counterclockwise direction by a predetermined angle and in a clockwise direction by a predetermined angle.

16. The apparatus for slicing a semiconductor wafer as set forth in claim 15, further comprising grinding means for grinding at least one of the semiconductor wafer while being cut and a planar surface of the semiconductor wafer after being cut.

17. The apparatus for slicing a semiconductor wafer as set forth in claim 15, wherein said rotating means rotates said semiconductor material about an axis passing through a position shifted from the cut surface of said semiconductor material by a predetermined value and perpendicularly intersecting the surface of the blade.

18. The apparatus for slicing a semiconductor wafer as set forth in claim 17, further comprising grinding means for grinding at least one of the semiconductor wafer while being cut and a planar surface of the semiconductor wafer after being cut.

19. The apparatus for slicing a semiconductor wafer as set forth in claim 17, wherein said rotating means rotates said semiconductor material in a counterclockwise direction by a predetermined angle and in a clockwise direction by a predetermined angle, alternately.

20. The apparatus for slicing a semiconductor wafer as set forth in claim 19, further comprising grinding means for grinding at least one of the semiconductor wafer while being cut and a planar surface of the semiconductor wafer after being cut.

21. The apparatus for slicing a semiconductor wafer as set forth in claim 12, further comprising grinding means for grinding at least one of the semiconductor wafer while being cut and a planar surface of the semiconductor wafer after being cut.

* * * * *